US009046232B2

(12) United States Patent
Melzner et al.

(10) Patent No.: US 9,046,232 B2
(45) Date of Patent: Jun. 2, 2015

(54) LIGHTING SYSTEM WITH LIGHT-EMITTING DIODE(S)

(75) Inventors: Erwin Melzner, Frasdorf (DE); Dennis Jackstien, Stephanskirchen (DE); Michael Jonischkeit, Alxing (DE); Kerstin Schlegel, Stephanskirchen (DE); Regine Kraemer, Munich (DE)

(73) Assignee: Arnold & Richter Cine Technik GmbH & Co. Betriebs KG, Munich (DE)

( * ) Notice: Subject to any disclaimer, the term of this patent is extended or adjusted under 35 U.S.C. 154(b) by 389 days.

(21) Appl. No.: 12/676,881

(22) PCT Filed: Sep. 3, 2008

(86) PCT No.: PCT/EP2008/061616

§ 371 (c)(1),
(2), (4) Date: Oct. 5, 2010

(87) PCT Pub. No.: WO2009/033992

PCT Pub. Date: Mar. 19, 2009

(65) Prior Publication Data

US 2011/0013395 A1 Jan. 20, 2011

(30) Foreign Application Priority Data

Sep. 7, 2007 (DE) ..... 10 2007 044 566

(51) Int. Cl.

| | |
|---|---|
| ***F21V 1/00*** | (2006.01) |
| ***F21S 2/00*** | (2006.01) |
| ***F21V 29/00*** | (2006.01) |

(Continued)

(52) U.S. Cl.

CPC . *F21S 2/005* (2013.01); *F21K 9/00* (2013.01); *F21V 21/005* (2013.01); *F21V 21/34* (2013.01); *F21V 23/0442* (2013.01); *F21V 23/06* (2013.01); *F21V 29/004* (2013.01);

(Continued)

(58) Field of Classification Search

None

See application file for complete search history.

(56) References Cited

U.S. PATENT DOCUMENTS

| | | | |
|---|---|---|---|
| 3,265,886 | A | 8/1966 | Wigert |
| D264,460 | S | 5/1982 | Möller |

(Continued)

FOREIGN PATENT DOCUMENTS

| | | | |
|---|---|---|---|
| DE | 203 11 557 | U1 | 11/2003 |
| DE | 20 2004 016 637 | U1 | 2/2005 |

(Continued)

OTHER PUBLICATIONS

English translation of International Preliminary Report on Patentability dated Jun. 10, 2010 for corresponding PCT Application No. PCT/EP2008/061616, 7 sheets.

(Continued)

*Primary Examiner* — Natalie Walford

(74) *Attorney, Agent, or Firm* — Christie, Parker & Hale, LLP

(57) ABSTRACT

A lighting system with at least one LED panel is provided. Said LED panel including a plurality of similar lighting modules, said lighting modules having controllable light-emitting diodes (LEDs) and a polygonal housing frame. Said polygonal housing frame comprising a board for receiving said lighting modules. Said polygonal housing frame including a plug connector on at least one side of the housing frame for positively mechanically coupling a sliding rail connection. Said plug connector including electrical contact means integrated in said mechanical sliding rail connection.

43 Claims, 37 Drawing Sheets

(51) Int. Cl.

| | |
|---|---|
| *F21K 99/00* | (2010.01) |
| *F21V 21/005* | (2006.01) |
| *F21V 21/34* | (2006.01) |
| *F21V 23/04* | (2006.01) |
| *F21V 23/06* | (2006.01) |
| *F21Y 101/02* | (2006.01) |

(52) U.S. Cl.

CPC ..... *F21V 29/225* (2013.01); *F21V 29/2262* (2013.01); *F21Y 2101/02* (2013.01)

(56) References Cited

U.S. PATENT DOCUMENTS

| | | | | |
|---|---|---|---|---|
| D297,527 | S | 9/1988 | Iacovelli | |
| 4,879,437 | A | 11/1989 | Dard et al. | |
| D356,567 | S | 3/1995 | Jones | |
| D368,429 | S | 4/1996 | Serio, Jr. | |
| D423,449 | S | 4/2000 | Naskali | |
| 6,065,854 | A | 5/2000 | West et al. | |
| D477,286 | S | 7/2003 | Krajci et al. | |
| D489,337 | S | 5/2004 | Murray | |
| D506,065 | S | 6/2005 | Sugino et al. | |
| D516,503 | S | 3/2006 | Takeshita et al. | |
| 7,101,058 | B2 | 9/2006 | Prell et al. | |
| 7,108,392 | B2 * | 9/2006 | Strip et al. | 362/145 |
| D533,846 | S | 12/2006 | Burton | |
| D548,684 | S | 8/2007 | Eto et al. | |
| D550,613 | S | 9/2007 | Hamasaki | |
| 7,274,302 | B2 | 9/2007 | Stevenson et al. | |
| D568,240 | S | 5/2008 | Haydvogel | |
| D572,192 | S | 7/2008 | Zhu | |
| D584,224 | S | 1/2009 | Mori et al. | |
| D602,857 | S | 10/2009 | Melzner et al. | |
| D602,877 | S | 10/2009 | Melzner et al. | |
| D603,345 | S | 11/2009 | Melzner et al. | |
| D603,350 | S | 11/2009 | Melzner et al. | |
| 8,111,022 | B2 * | 2/2012 | Snijder et al. | 315/312 |
| 8,581,513 | B1 * | 11/2013 | Reinoso | 315/291 |
| 2001/0024368 | A1 | 9/2001 | Henrici et al. | |
| 2005/0007780 | A1 | 1/2005 | Feuerborn et al. | |
| 2005/0024868 | A1 | 2/2005 | Nagai et al. | |
| 2006/0057461 | A1 | 3/2006 | Hamada et al. | |
| 2006/0160409 | A1 | 7/2006 | Shimizu et al. | |
| 2006/0274531 | A1 | 12/2006 | Kopf et al. | |
| 2007/0058377 | A1 | 3/2007 | Zampini, II et al. | |
| 2007/0273290 | A1 * | 11/2007 | Ashdown et al. | 315/113 |
| 2008/0310152 | A1 | 12/2008 | Verbrugh et al. | |

FOREIGN PATENT DOCUMENTS

| | | | |
|---|---|---|---|
| DE | 4 07 04 520 | | 12/2007 |
| DE | 40 2008 001 754 | | 5/2008 |
| DE | 10 2007 044 567 | A1 | 3/2009 |
| EP | 0 921 568 | A2 | 6/1999 |
| EP | 1 134 849 | A1 | 9/2001 |
| EP | 1 729 059 | A2 | 12/2006 |
| JP | 59-134579 | A | 8/1984 |
| JP | 02-012107 | U | 1/1990 |
| JP | 11-283404 | A | 10/1999 |
| JP | 2000-067606 | A | 3/2000 |
| JP | 2005-183222 | A | 7/2005 |
| JP | 2006-261039 | A | 9/2006 |
| JP | 2007-042517 | A | 2/2007 |
| WO | WO 2005/024291 | A2 | 3/2005 |
| WO | WO 2005/100851 | A1 | 10/2005 |
| WO | WO 2005/107411 | A2 | 11/2005 |
| WO | WO 2006/003569 | A1 | 1/2006 |
| WO | WO 2006/056066 | A1 | 6/2006 |
| WO | WO 2006/091435 | A1 | 8/2006 |
| WO | WO 2007/069130 | A2 | 6/2007 |

OTHER PUBLICATIONS

International Search Report, dated Feb. 20, 2009, corresponding to PCT/EP2008/061616.

U.S. Appl. No. 29/325,719, filed Oct. 3, 2008, Erwin Melzner et al., Entitled Spotlight System.

English translation of Japanese Examination Report dated Feb. 12, 2013 for Application No. 2010-523497, 3 pages.

* cited by examiner

LIGHTING SYSTEM WITH LIGHT-EMITTING DIODE(S)

CROSS-REFERENCE TO A RELATED APPLICATION

This application is a National Phase Patent Application of International Patent Application Number PCT/EP2008/061616, filed on Sep. 3, 2008, which claims priority of German Patent Application Number 10 2007 044 566.2, filed on Sep. 7, 2007.

BACKGROUND

This invention relates to a lighting system with at least one LED panel.

Illuminants referred to as light diodes, light-emitting diodes or LEDs offer the possibility of producing flat lampheads homogeneously emitting light over their surface, which in larger constructions as surface luminaires named "Softlight", "Filllight" or lightener can be used in all fields of professional lighting, as portrait lamps in the direct vicinity of a motion picture or video camera, in confined spaces, such as vehicles and staircases, and for the erection of light walls for event or stage lighting.

From EP 0 921 568 A2 a lighting device is known, in which a plurality of LED chips emitting monochromatic light of different colors are inserted into depressions of a three-dimensional carrier of rectangular cross-section, are electrically connected with conductors and sealed with a transparent plastic material. In emission direction of the LED chips, a diffuser plate of transparent plastic material, which consists of microlenses for light control, is connected with the three-dimensional carrier. The matrix-like combination of a plurality of modules with LEDs emitting monochromatic red, green, blue and yellow light with different color mixture and light scatter, which are arranged in the depressions of the carrier, leads to a lighting device with adjustable light color and light scatter.

SUMMARY

It is the object of the present invention to provide a lighting system with light-emitting diodes (LEDs), which emits light with variable color, brightness and radiation characteristic and can be configured and expanded as desired in modular form.

The solution in accordance with the invention provides a lighting system with light-emitting diodes, which emits light with variable color, brightness and radiation characteristic and can be configured and expanded as desired in modular form. The modular configuration of the lighting system with light-emitting diodes selectively provides for a compact or large-surface design for an LED lamphead or an LED surface luminaire in conjunction with a suitable optic for bundling or expanding the light beams emitted by the LEDs and for connection with decentralized control means to be assigned to the individual LED panels and/or with a central control means assigned to a plurality of interconnected LED panels for adjusting parameters such as light color, color temperature and chrominance as well as brightness of the light emitted by the lighting modules of the LED panel.

The lighting system includes at least one LED panel, but preferably a plurality of LED panels connected with each other at least mechanically, preferably however both electrically and mechanically, which include a polygonal, preferably rectangular housing frame with one or more connecting structures either for mechanical coupling only or for mechanical coupling and electrical connection with similar LED panels, a board integrated in the housing frame for accommodating the lighting modules and a mount arranged on the upper surface of the housing frame for an optical device. The individual lighting modules integrated in the LED panel include the LEDs combined to one light source and emitting light of different wavelengths, a module electronic for actuating the LEDs, a module carrier for accommodating the LEDs and the module electronic as well as a heat sink accommodating the LEDs and connected with the module carrier.

By expanding the lighting module with one or more temperature and/or color sensors, which together with the LEDs are arranged in compact form on a circuit board connected with the module carrier, an autonomous electric actuation and control of the light source formed of the LEDs by means of the module electronic including a microcontroller is possible.

In a further exemplary aspect, an optic for light mixing and/or beam forming can be coupled to the lighting module. By arranging a multitude of lighting modules, whose module electronic is connected with a superordinate control and regulating means, a controllable and adjustable light source for a lighting equipment can be produced, which can be connected with further optical devices for beam forming.

By corresponding selection and composition of the LEDs emitting light of different wavelengths and their arrangement on the board of the light source and by a corresponding actuation of the LEDs by the module electronic, the lighting module can emit a light mixture whose parameters such as light color, color temperature and chrominance are adjustable beside the brightness of the light emitted by the lighting module.

With an individual actuation of LEDs emitting light of different wavelengths or groups of LEDs each emitting light of the same wavelength by the module electronic, a selective and temperature-independent adjustment of the light mixture consisting of the light emitted by the differently colored LEDs is ensured.

The module electronic equipped with a microcontroller provides for varying the control program for actuating the LEDs or for connecting the lighting module with a superordinate, external controller, i.e. a controller separate from the lighting module, so that the module electronic of the lighting module performs the entire control and possibly regulation of the autonomous lighting module and hence relieves the external controller.

Exemplary, the module electronic controls the LEDs in dependence on the temperature and/or performance of the lighting module and/or the brightness and/or the color of the light mixture emitted by the lighting module such that the brightness, color and chrominance of the light mixture composed of the LEDs emitting light of different wavelengths is constant, which provides for a local temperature compensation and an autonomous lighting module without the necessity or requirement of an external control and regulating means.

The bottom surface of the housing frame constitutes a heat sink surface with cooling fins, in which at least one mount for a positively insertable connecting element, in particular for a spigot connectable with a carrier element such as a stand, a rig or the like is integrated.

The heat sink surface provided with cooling fins on the bottom surface of the housing frame is connected with the heat sinks accommodating the LEDs of the lighting modules in a thermally well-conducting manner, so that the heat emitted by the LEDs is optimally dissipated via the cooling fins of the heat sink surface and as a result lighting modules with great performance can be used. Due to the integration of mounts for a positively insertable connecting element into the heat sink surface, a compact design of the LED panels and their safe connection with a carrier element such as a stand or a rig are ensured.

The board arranged in the housing frame of the LED panel includes openings and fastening devices for the lighting modules, a power supply means and interface electronic for the lighting modules, a microprocessor for colorimetric calculations and a convection temperature compensation as well as connectors arranged at the lateral edges of the board and aligned vertical to the board with a connecting structure for the positive mechanical coupling and for the electroconductive connection. The board thus serves as a carrier both for the individual lighting modules of the LED panel and for the power supply means and interface electronic for electrically coupling the lighting modules with a microprocessor likewise arranged on the board. Via the input and output connectors arranged at the lateral edges of the board, the LED panel can be connected with further LED panels, with a decentralized control element assigned to the LED panel or to a group of interconnected LED panels and/or with a central power control unit actuating a plurality of LED panels.

The rectangular, in particular square lighting modules are connected with the board in a matrix-like grating structure with a plurality of rows and columns, wherein the heat sinks connected with the module carriers of the lighting modules can be inserted in openings of the board and are connected with the heat sink surface arranged at the bottom surface of the LED panel in a thermally well-conduction manner, so that an optimum heat transfer from the LEDs to the heat sink surface is ensured and as a result the light output of the LEDs can fully be utilized.

In an exemplary embodiment, the LED panel has a rectangular housing frame, whose upper surface can be connected with an optical device, which includes optics associated to the lighting modules and/or an optic common to all lighting modules.

To expand the lighting system, the LED panels can positively be connected with each other at least on the narrow sides of their rectangular housing frame, and a plurality of LED panels connected with each other in rows can mechanically and/or electrically be coupled with each other via cross connectors.

For an autonomous operation independent of an external power supply, an accumulator to be coupled to the connecting structure of at least one LED panel, preferably adapted to the shape of the LED panel can be provided, which feeds the LED panel connected with the same or a plurality of LED panels mechanically and electrically coupled with the same.

For individually actuating or adjusting light parameters of the lighting modules of an LED panel, a control element to be attached to the connecting structure of the LED panel and electrically connectable with the module electronic of the lighting modules of the LED panel is provided, which after the input of data or the adjustment of parameters can again be separated from the LED panel. As a result, for example a fine adjustment of the LED panels for the emission of light with a desired chrominance and brightness and/or for the different adjustment of the LED panels to generate light effects is possible.

In an exemplary embodiment, the control element includes a step switch with which a number of preprogrammed light settings, so-called presets, can be adjusted. As a result, it is possible for example that before use of the LED panel on location or in the studio the user is preprogramming certain frequently used settings and can quickly retrieve the same later on, if required, without having to connect the LED panels to more complex, large and heavy operating devices, such as e.g. DMX consoles or computers. This is advantageous in particular for film shots on confined locations, in which possibly also high time pressure exists. Furthermore, the control element also includes a dimmer and an on/off switch. Each setting on the control element equally influences all subsequently electrically connected LED panels, so that even larger combinations of LED panels can be operated quickly and easily by using the control element.

Furthermore, for power supply and data transmission a plug can be plugged into the connecting structure of at least one of the LED panels, which via a power supply and data transmission cable is connected with a further LED panel or with a central power control unit, so that larger lighting units of a plurality of LED panels can electrically be connected with each other.

For mechanically connecting the LED panels, cross connectors or plug connectors, the connecting structure preferably constitutes a sliding rail connection in the manner of a dovetail connection, a connection of a slotted box profile with a T-section or the like with an end stop and includes spring contact pins and flat contacts for electrical connection of the LED panels, cross connectors or plug connectors.

The central power control unit actuating an individual LED panel or a plurality of LED panels preferably consists of a power supply and docking station with at least one terminal for receiving a power supply and data transmission line to at least one LED panel and of a control device connected or connectable with the power supply and docking station, which includes a wireless and/or wire-bound connection to the power supply and docking station and is connectable with the power supply and docking station via a plug receptacle, so that an operation of the control device is possible both at the power supply and docking station and separate from the power supply and docking station and hence a comfortable operation for example of LED panels arranged at a larger height is ensured.

If the LED panel is intended to emit light only in a preprogrammed setting, a so-called "power adapter" can also be connected to the LED panel or an LED-panel group 1' instead of a power supply and docking station and a control device, which only includes a socket for the power supply to the LED panel or the LED-panel group 1'.

In an alternative embodiment, the power supply and docking station is omitted and the control device performs all control functions. In this embodiment, a data radio module is plugged onto each LED panel or each LED panel group, which directly communicates with the control device, wherein to the respective radio module or LED panel or to each LED panel group power is only supplied from a power supply unit or a battery and the data transmission is effected by radio.

If an actuation via DMX 512, via a Personal Computer or via a serial interface is desired, the control device still performs the communication, wherein a so-called system distributor then is connected to the control device, which contains the plug connectors and signal converters required for this purpose.

The radio modules can be adjusted to various (hardware) channels, i.e. to various frequencies and (software) addresses, so that either a plurality of LED panels or LED panel groups are simultaneously actuated on the same channel or each LED panel or each LED panel group is operated on a separate channel.

The receiving device of the LED panels for the optical device provided for light forming can consist of a plug connection arranged at the upper edge of the frame, of a tongue-and-groove connection or of a magnet device, which is connected with the board on the one hand and with the optical device on the other hand and provides for a safe connection and release of the optical device with and from the LED panel.

On its light-radiating side, the LED panel either is covered by a non-reflecting glass pane or includes a continuous plastic cover on its light-radiating side, in which only the openings for the light-emitting LEDs are kept free. These openings can in turn be covered with individual, preferably non-reflecting glass panes.

The advantage of the continuous plastic cover with openings for the LEDs consists in the greater strength as compared to a large glass plate, which is sensitive to tensions and impact loads, and in the possibility to mount a shielding plate above the individual LEDs below the plastic cover, so that the susceptibility to interference and the emission of interfering signals can be reduced effectively.

The rectangular housing frame of the LED panel preferably constitutes a plastic frame, which partly protrudes beyond the heat sink surface, so that the LED panel need not be touched at the hot heat sink surface, but can be grasped at the distinctly cooler plastic surface.

The optical device can consist in a soft optic with an array of reflectors with a central opening, which are assigned to the individual lighting modules of the LED panels and in particular constitute conical mirrors or parabolic mirrors, which couple the light radiated from the LEDs of the lighting modules into a full light guide. The light guide serves to thoroughly mix the radiated colored light and preferably is made of polymethyl methacrylate (PMMA) or polycarbonate (PC). On its upper surface it preferably has a defined roughness or preferably regular structures, such as triangular grooves milled in at an angle of 120°, in order to prevent the total reflection back into the light guide at this point and facilitate the exit of the light beams to the top.

To increase the brightness and improve the light mixture, the full light guide is surrounded with a highly reflecting cover or coating on the bottom surface and on the sides, which preferably is configured as a reflector sheet, which at the same serves as a mechanically stable frame for the soft optic. To achieve a homogeneously radiating luminous area, a diffuse plate or foil also is attached at a small distance from the described arrangement, which again collects the light radiated from the full light guide and from the lateral reflector sheets, further intermixes the same and again uniformly radiates the same as a secondary source. With the arrangement described above it is possible to achieve thorough mixing of the light from the individual lighting modules with a comparatively small construction height.

With equal light emission of the individual LEDs of the LED panel, the light scattering plate with the openings provided therein and the reflectors inserted therein can be omitted in the soft optic, since in this case mixing the light emitted by the LEDs no longer is required in the soft optic. In this case, the soft optic preferably only consists of the highly mirrored plastic or sheet metal housing and of the diffusely reflecting plate, which is attached to the LED panel in particular by means of magnets glued onto the bottom of the sheet metal housing.

Alternatively, the optical device can constitute a spot optic and include lens systems arranged in a lens frame and associated to the individual lighting modules, which in particular consist of TIR lenses with honeycomb condensers placed on top.

The soft optic and the spot optic, respectively, in turn can include magnets on which further optical accessories, such as diffusion foils, diffusion plates, egg crates or the like, can be attached.

BRIEF DESCRIPTION OF THE DRAWINGS

With reference to embodiments illustrated in the drawing the construction and operation of the lighting system in accordance with the invention will be explained in detail. In the drawing.

DETAILED DESCRIPTION

Figure 1:
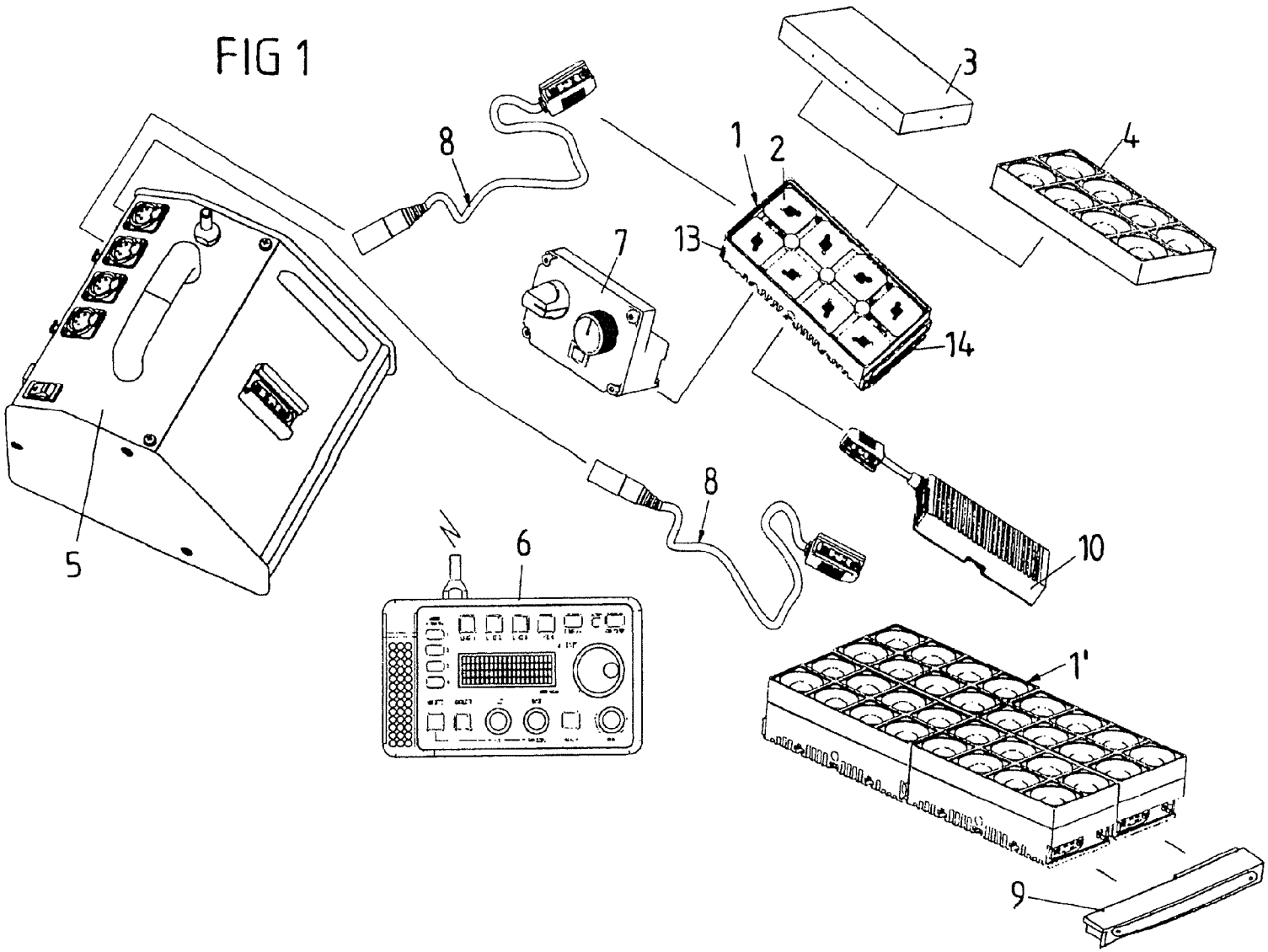
FIG. 1 shows a schematic overview diagram of an embodiment of a lighting system with an LED panel and a plurality of LED panels combined to a group.

The overview of the individual function elements of the modular lighting system of the invention, which is illustrated in FIG. 1, shows an individual LED panel 1, in which eight lighting modules 2 with a light source composed of LEDs emitting light of different wavelengths and hence colors are arranged. The LED panel 1 forms a luminous body, which by means of a soft optic 3 or spot optic 4 to be mounted on the upper surface of the LED panel 1 for an additional light mixture of the LEDs emitting light of different wavelengths and hence colors can additionally be expanded by a desired beam forming. The LED panels 1 include lateral electromechanical plug connectors 13, 14, via which a plurality of LED panels 1 can electrically and mechanically be connected to form a row of LED panels. Via additional cross connectors 9, a plurality of LED panel rows can be joined to form an LED panel group 1' with a matrix-like structure.

To an individual LED panel 1 or to an LED panel group 1' an individual control element 7 can be connected for the decentralized actuation of the respective LED panel 1 or LED panel group 1' and provides for an individual actuation or adjustment of light parameters of the lighting modules of the respective LED panel 1 or LED panel group 1'. After entering data or setting the parameters, the control element 7 can again be separated from the LED panel 1.

For the autonomous power supply, an individual LED panel 1 or an LED panel group 1' can be connected with an accumulator 10, which preferably likewise can be plugged onto the LED panel 1 or the LED panel group 1' directly or via a connecting element.

A central power control unit 5, 6 serves for supplying power to an LED panel 1 or an LED panel group 1' and for entering nominal values for actuating the lighting modules 2 of the individual LED panels 1 and consists of a power supply and docking station 5 and a control device 6, which can be connected to the power supply and docking station 5 or can be operated via a radio or line connection separate from the power supply and docking station 5. The power supply and docking station 5 includes a plurality of sockets, which via connecting cables 8 accomplish an electrical connection for the power supply and actuation of the LED panel 1 or LED panel group 1'.

In this embodiment, preferably all LED panels 1 or LED panel groups 1' are coupled to the power supply and docking station 5 in a star-shaped manner by means of power and data cables.

Figure 2:
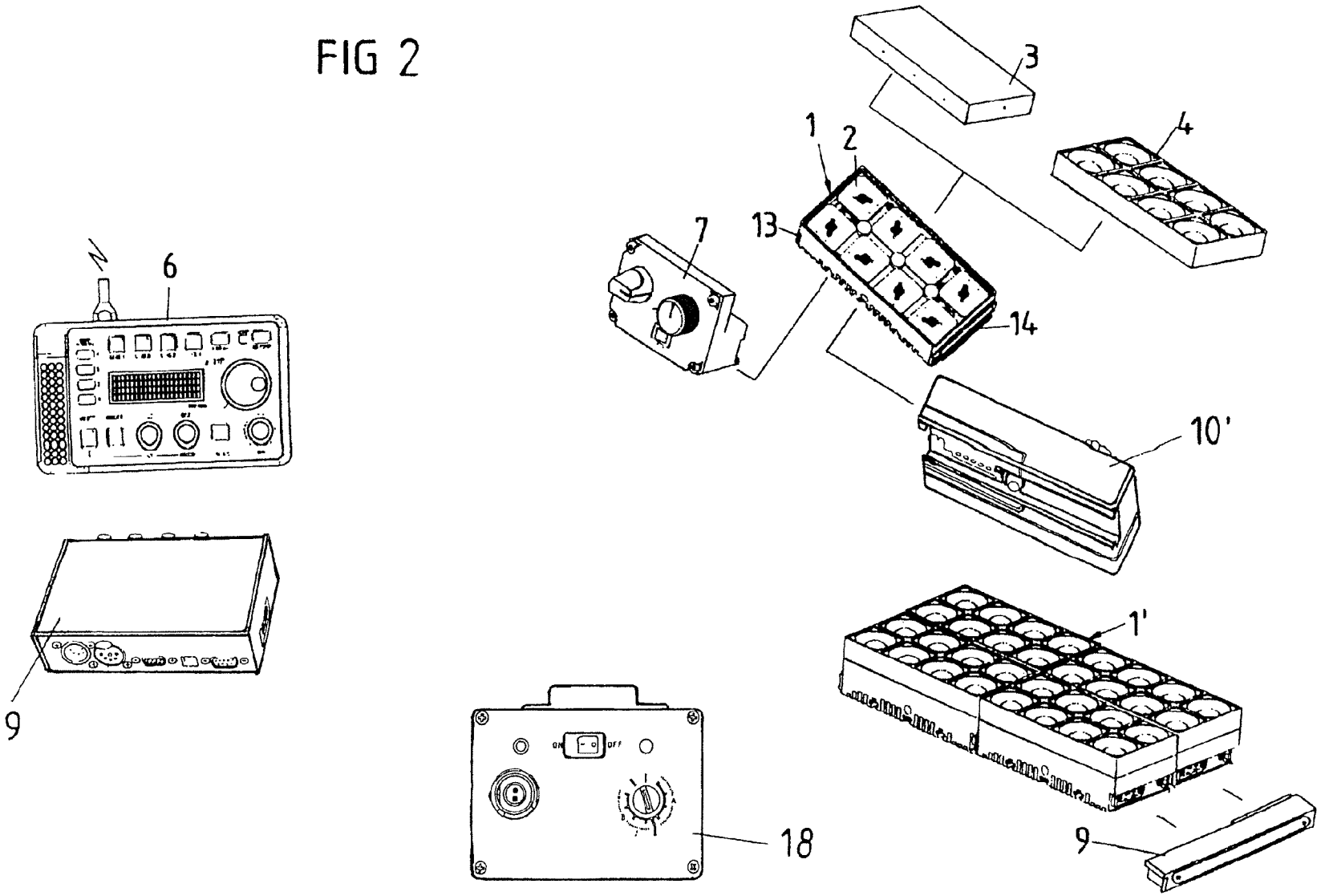
FIG. 2 shows a schematic overview diagram of an other embodiment of a lighting system with an LED panel and a plurality of LED panels combined to a group.

In an overview of the individual function elements of the modular lighting system of the invention as shown in FIG. 2, the power supply and docking station 5 is omitted in an alternative embodiment and the control device 6 performs all control functions. In this embodiment, a data radio module 18 is plugged onto each LED panel 1 or each LED panel group 1', which directly communicates with the control device 6, wherein to the respective data radio module 18 or LED panel 1 or to each LED panel group 1' power is only supplied from a power supply unit or a battery 10' and the data transmission is effected by radio.

If an actuation via DMX 512, via a personal computer or via a serial interface is desired, the control device 6 still performs the communication, wherein a so-called system distributor 9 is connected to the control device 6, which contains the plug connectors and signal converters required for this purpose.

The data radio modules 18 can be adjusted to various (hardware) channels, i.e. to various frequencies and (software) addresses, so that either a plurality of LED panels 1 or LED panel groups 1' are simultaneously actuated on the same channel or each LED panel 1 or each LED panel group 1' is operated on a separate channel.

If the LED panel 1 or the LED panel group 1' is intended to emit light only in a preprogrammed setting, a so-called "power adapter" 10' can also be connected to the LED panel 1 or to an LED-panel group 1' instead of a power supply and docking station 5 and a control device, which only includes a socket for the power supply to the LED panel or to the LED-panel group 1'.

In the case of a failure and disturbance of the radio connection between the control device 6 and a data radio module 18 connected with an LED panel 1 or an LED panel group 1', an emergency connection can be established via cable. The data radio modules 18, the control device 6, the decentralized control element 7 and the power adapter therefore have a jack socket, into which a data cable can be plugged. Via this connection, a software update (download) can also be performed, if necessary.

In the following, the construction and operation of the individual function elements of the modular lighting system schematically illustrated in FIGS. 1 and 2 as well as their cooperation will be explained in detail.

Figure 3:
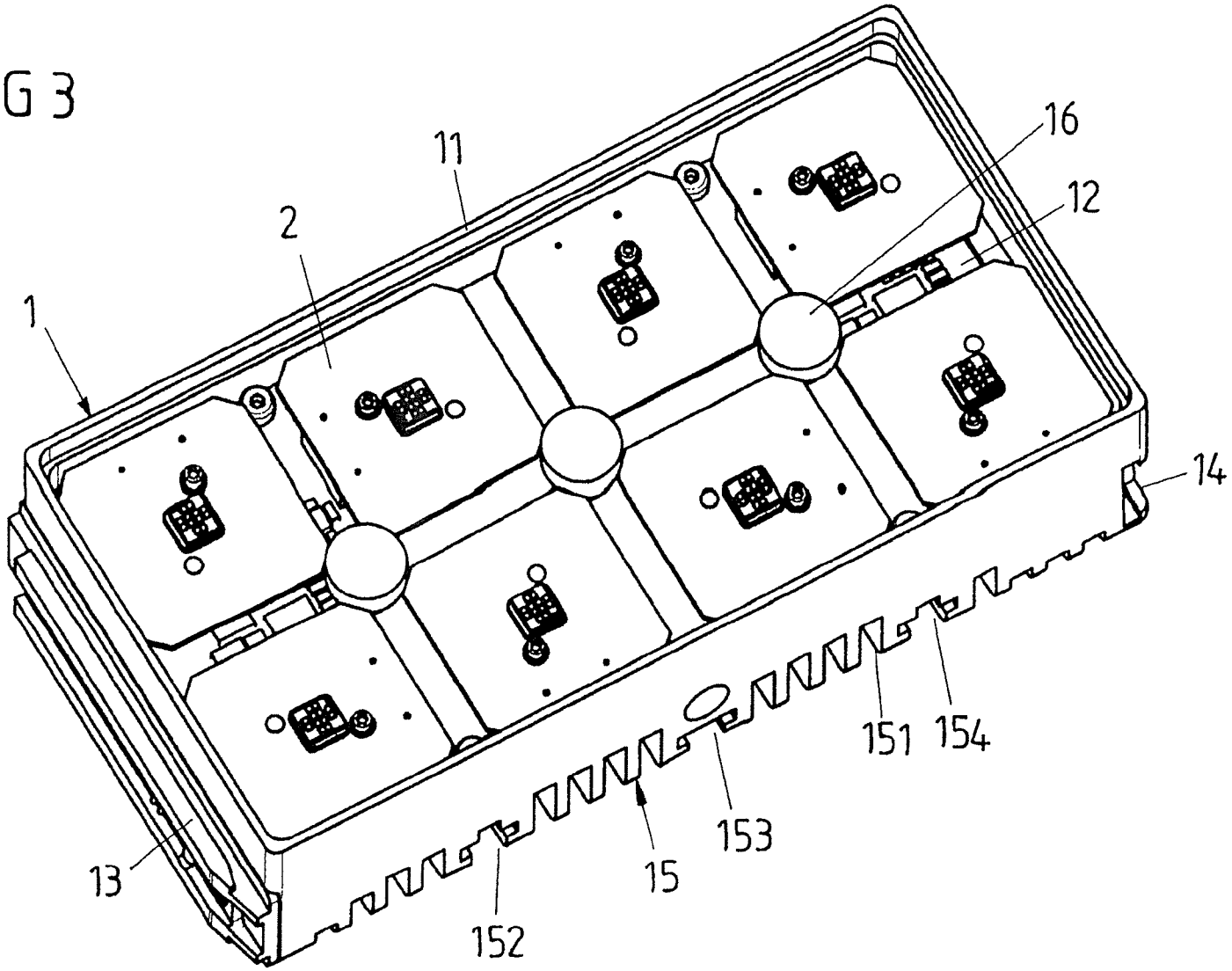
FIG. 3 shows an isometric view of an LED panel with eight lighting modules.
Figure 4:
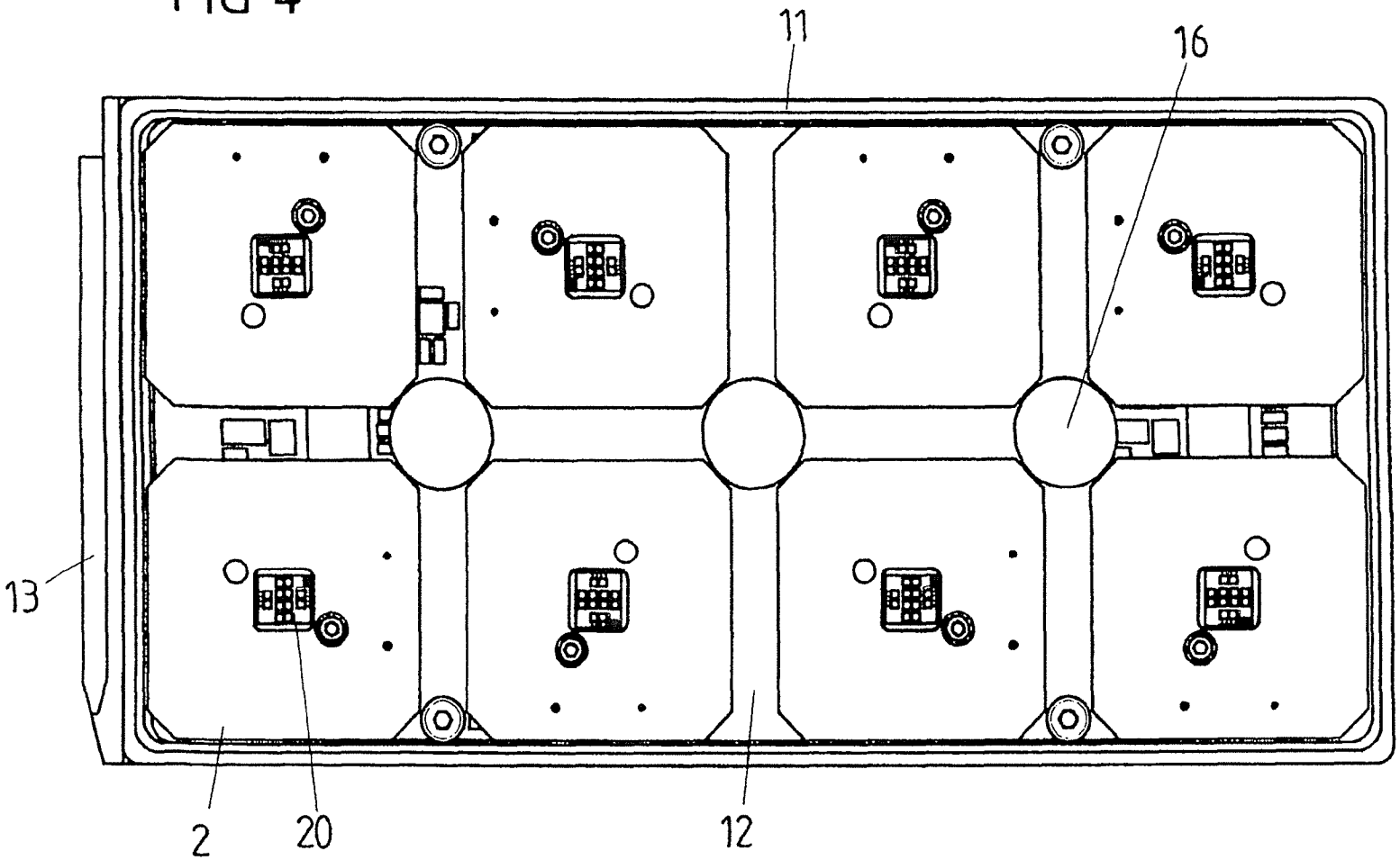
FIG. 4 shows a top view of the LED panel as shown in FIG. 3.

FIG. 3 shows an isometric view and FIG. 4 a top view of an LED panel 1 which includes a rectangular housing frame 11 with a closed bottom surface constituting a heat sink surface 15 with cooling fins 151, into which a board 12 can be inserted and which on its narrow sides includes input plug connectors 13 connected with the board 12 as well as output plug connectors 14. The board 12 is mechanically and electrically connected with eight identically formed lighting modules 2. Between the lighting modules 2 arranged in two rows and eight columns, three mounting magnets 16 are arranged, which serve for attachment of an optical device in the form of the soft optic 3 or the spot optic 4 as shown in FIGS. 1 and 2, which can be mounted on the housing frame 11.

The rectangular housing frame 11 of the LED panel 1 preferably constitutes a plastic frame, which partly protrudes beyond the heat sink surface 15, so that the LED panel 1 need not be touched at the hot heat sink surface 15, but can be grasped at the distinctly cooler plastic surface.

The soft optic 3 and the spot optic 4, respectively, in turn can include magnets on which further optical accessories, such as diffusion foils, diffusion plates, egg crates or the like, can be attached.

In the heat sink surface 15 forming the bottom surface of the housing frame 11, three mounts 152, 153, 154 are integrated, into which a connecting element can be inserted and positively be connected with the LED panel 1. As connecting element, a connecting pin connected or connectable with a stand, a rig or some other carrier element in particular is used, as it is shown and described for example in FIGS. 30 and 31. The mounts 152, 153, 154 are formed in the manner of a slotted box section with and without additional groove, whereas the connecting pin has a corresponding T-shaped counter-profile, which by plugging on the connecting pin from the side of the housing frame 11 can be inserted into the mounts 152, 153, 154 and can be brought in engagement with the LED panel 1 or can be secured by a clamping device.

Figure 5:
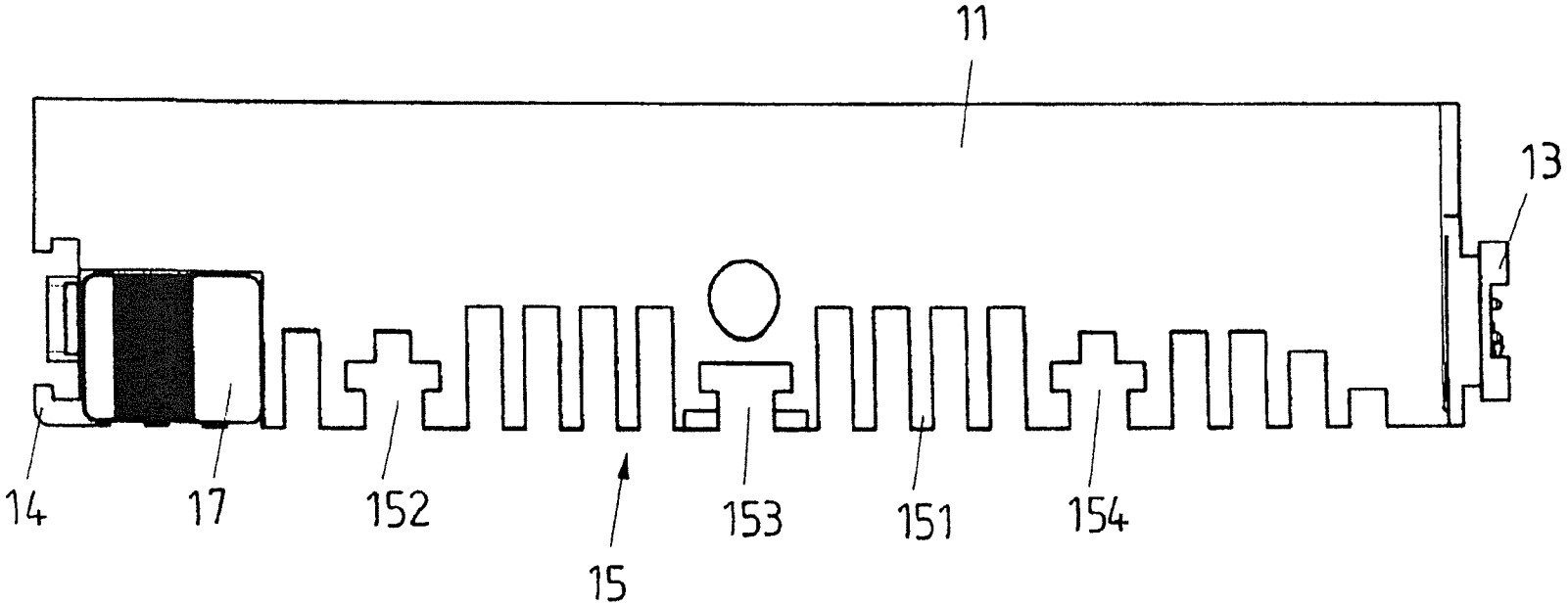
FIG. 5 shows a side view of the LED panel as shown in FIG. 3.

A side view of the LED panel 1 is shown in FIG. 5, which on the left side shows a slide 17 for unlocking and to the left an output plug connector 14 with flat contacts and to the right an input plug connector 13 with spring contact pins, whereas on the bottom surface the heat sink surface 15 with the cooling fins 151 and with the cross- and T-shaped recesses 152, 153, 154 for insertion of a connecting pin, in particular a stand pin, and in the middle a thread for screwing the LED panel 1 onto stands, clamps and the like can be seen.

Figure 6:
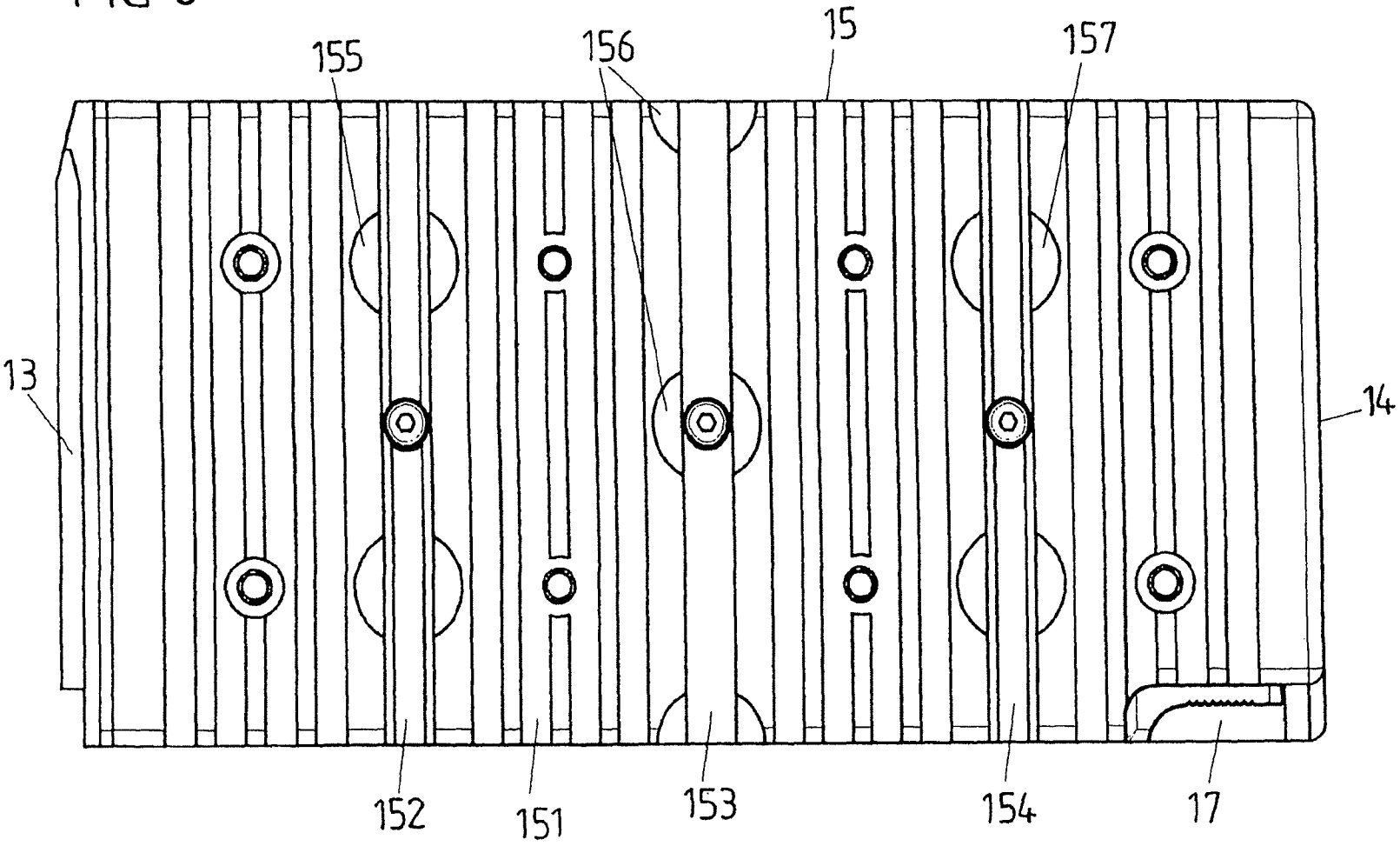
FIG. 6 shows a bottom view of the LED panel as shown in FIG. 3.

The bottom view of the LED panel 1 illustrated in FIG. 6 shows a top view of the cooling fins 151 of the heat sink surface 15, on the left narrow side the input plug connector 13 of the LED panel 1 and on the right side the output of the LED panel 1 with the slide 17 for unlocking the connection of a connecting plug or a further LED panel. There are seven circular or semicircular depressions 155, 156, 157, in which a connecting pin inserted into the recesses 152, 153, 154 positively engages in the recesses 152, 153, 154 when it is inserted and pushed into the same.

In the illustrated form, the LED panel 1 shown in FIGS. 3 to 6 can already be used as a wide-angled and flat light source without optical device placed on top.

The LED panel 1 selectively can be provided with a continuous, non-reflecting glass pane or with a continuous plastic cover, in which only the openings for the light-emitting LEDs are kept free. The advantage of the continuous plastic cover with openings for the LEDs consists in the greater strength as compared to a large glass plate, which is sensitive to tensions and impact loads, and in the possibility to mount a shielding plate above the individual LEDs below the plastic cover, so that the susceptibility to interference and the emission of interfering signals can be reduced effectively.

Figure 7:
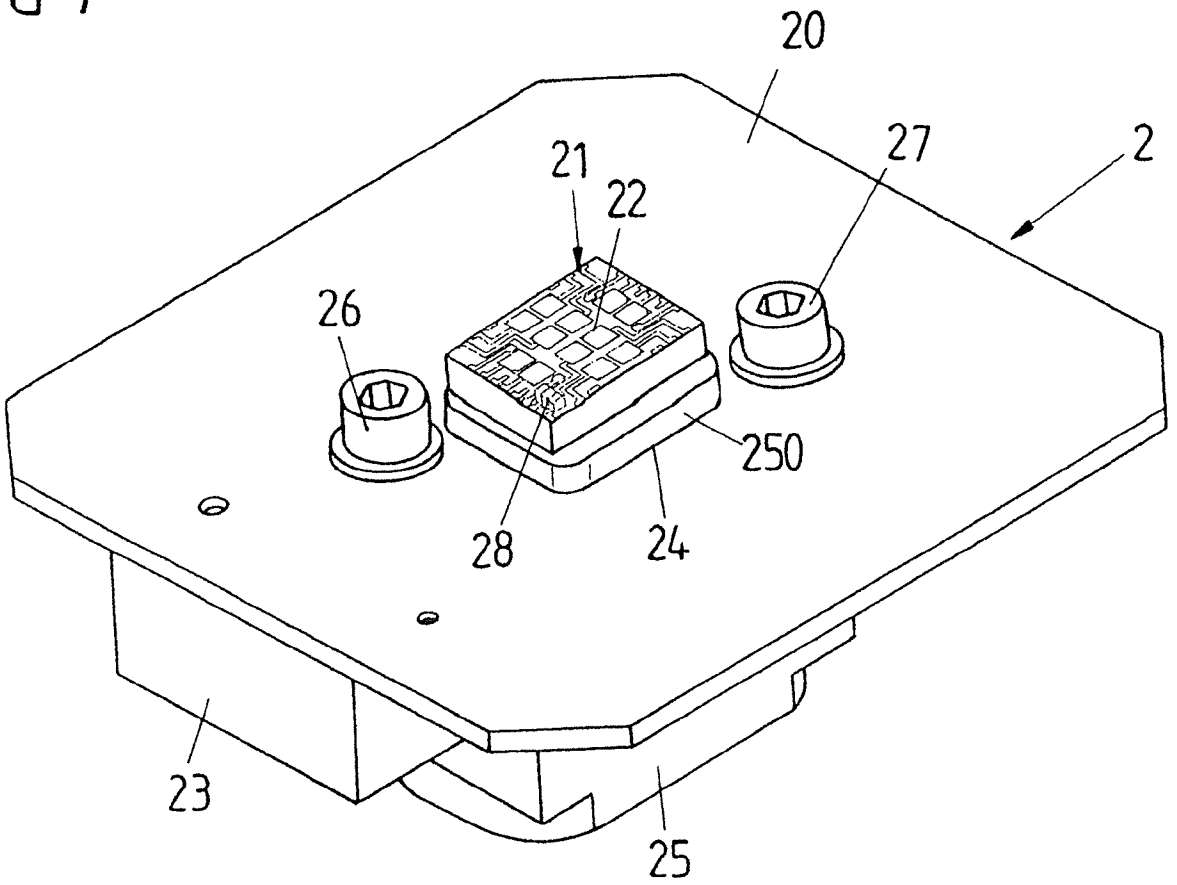
FIG. 7 shows an isometric view of a lighting module with a plurality of LEDs forming a light source.

FIG. 7 shows a perspective representation of a lighting module 2, which consists of a tetragonal module carrier 20 formed as circuit board, on which a module electronic is arranged and which includes a recess 24, through which a base 250 of a module heat sink 25 protruding above the surface of the module carrier 20 is inserted, and which towards the bottom is connected with a connector strip 23, via which the module electronic is connected with the decentralized control element 7 or the central power control unit 5, 6. On the base 250 of the module heat sink 25 a light source 21 with a plurality of LEDs 22, twelve in this embodiment, arranged on a cuboid metal core board, pairs of which emit light of different wavelengths and hence colors, a temperature sensor 28 and conductors for connecting the LEDs 22 and the temperature sensor 28 to the edges of the metal core board are arranged, from where they are connected with the module electronic via a direct wire or bond connection.

Beside an optimum dissipation of the heat emitted by the LEDs 22 via the metal core board and the module heat sink 25 to the heat sink surface 15 of the LED panel 1, the lighting module 2 shown in FIG. 7 is characterized by a safe and simple mechanical connection between the lighting module 2 and a lamphead housing or a cooling means, wherein the module carrier 20 is not subjected to a mechanical load and the light source 21 is arranged such that the optical path of the LEDs 22 is not disturbed by fastening elements 26, 27 on the module carrier 2 or by the non-illustrated electronic components of the module electronic, so that the optic arranged downstream in emission direction of the light source 21 can collect the light beams emitted by the LEDs 22 and can shape the same very effectively.

For an optimum dissipation of the heat emitted by the light source 21 in operation of the lighting module 2, the heat sink 25 is made of a material conducting heat very well, such as copper or aluminum, and on its bottom surface has a threaded bore, via which a safe and simple mechanical connection of the entire lighting module 2 with the LED panel 1 can be accomplished.

The connection of the module electronic with the decentralized control element 7 or the central power control unit 5, 6 as well as the power supply of the lighting module is effected via the connector strip 23 on the bottom surface of the module carrier 20, which in one embodiment includes five contacts which are connected with two voltage sources, a ground potential and with two contacts of a serial interface to the decentralized control element 7 or the central power control unit 5, 6.

The LEDs 22 are composed of a plurality of LEDs which emit light of different wavelengths, i.e. of different colors, wherein several LEDs also can radiate the same wavelength, i.e. light of the same color. By close arrangement of the LEDs 22 on the metal core board, there is already generated a light mixture of the different colors adjustable by corresponding selection of the LEDs, which is further optimized by additional measures such as optical light bundling and light mixing and can be kept constant by further control and regulating measures, for example independent of the temperature, in order to be able to adjust a desired color temperature, brightness and the like.

Figure 8:
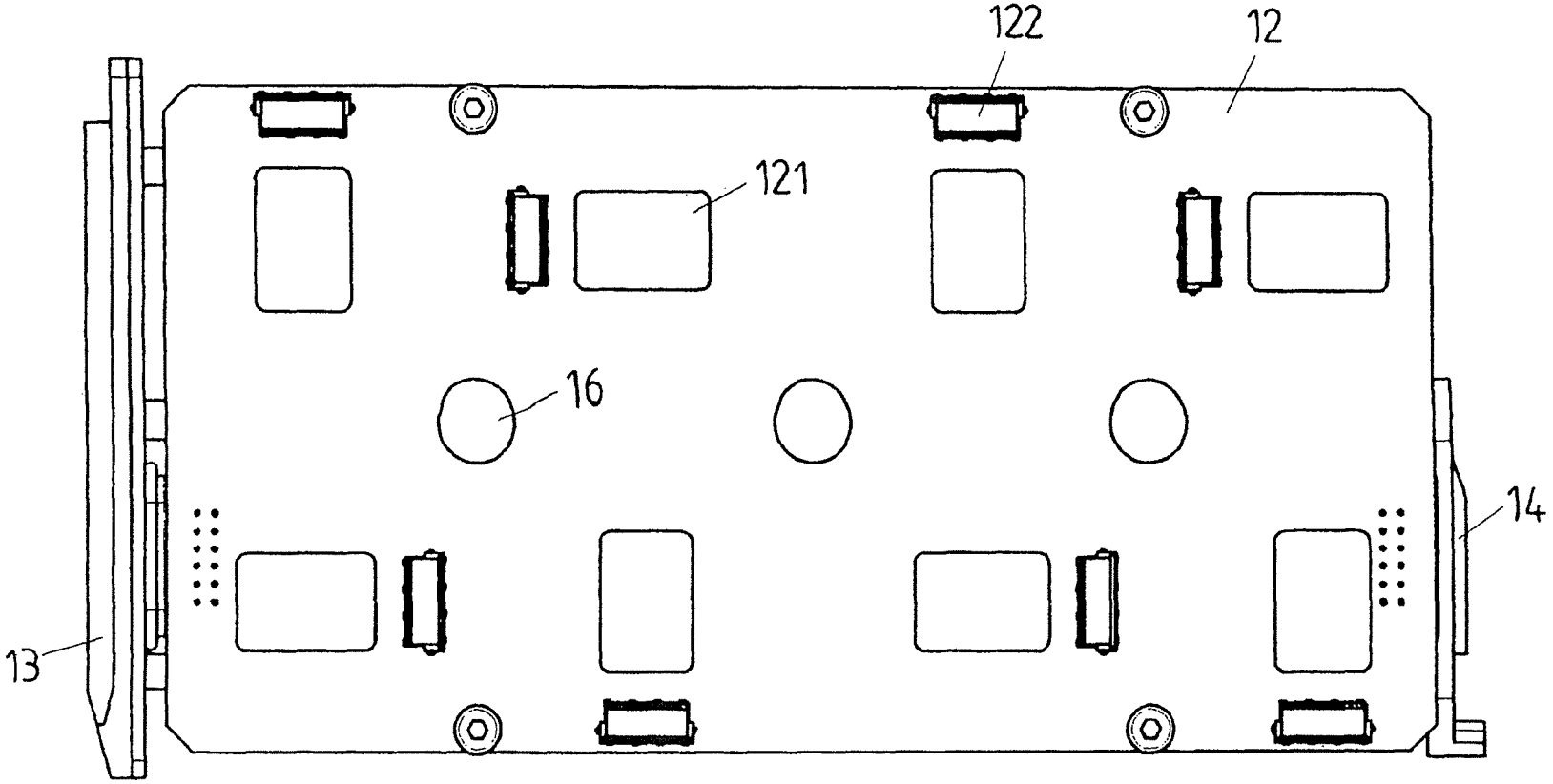
FIG. 8 shows a top view of a board of the LED panel without equipment.

FIG. 8 shows a top view of the board 12 of an LED panel 1, which is formed as motherboard and among other things includes a controller and further memory, control and interface elements. In the likewise rectangular board 12 eight openings 121 each with a different orientation for inserting the module heat sinks 25 of the lighting module 2 as well as sockets 122 for accommodating the connector strips 23 of the lighting modules 2 are provided. For a better understanding, the electronic components of the memory, control and interface elements arranged on both sides of the board 12 are omitted in the top view of FIG. 8. On its narrow sides, the rectangular board 12 includes the input plug connector 13 and the output plug connector 14, which are aligned vertical to the plane of the board 12 and form signal inputs and outputs as well as power supply contacts of the LED panel 1. In the center of the board 12, the mounting magnets 16 arranged at a distance from each other are arranged for attachment of the optical device 3, 4 as shown in FIGS. 1 and 2.

Figure 9:
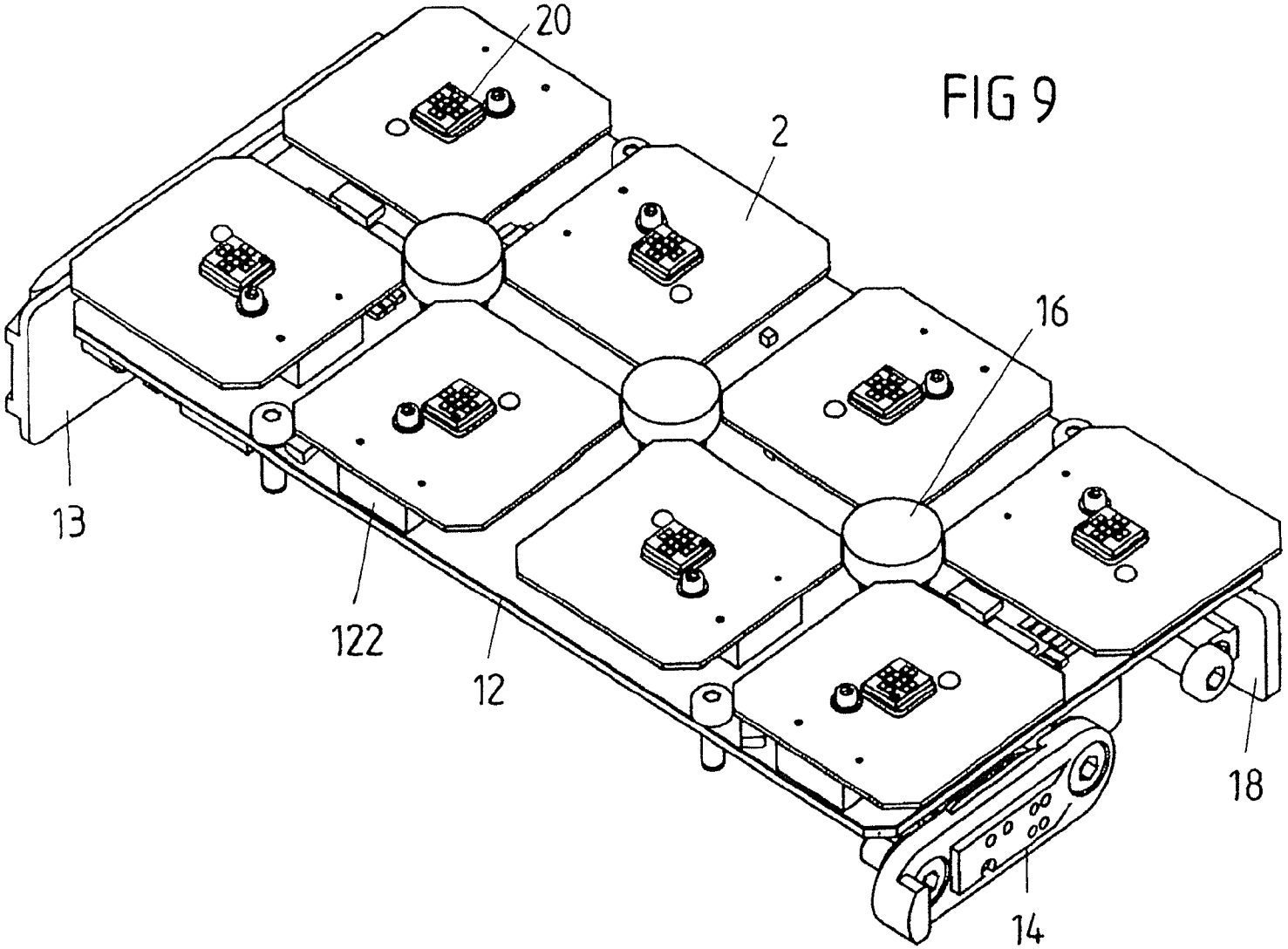
FIG. 9 shows an isometric view of the board of an LED panel from the upper surface with eight lighting modules, electronic components and lateral plug connectors.
Figure 10:
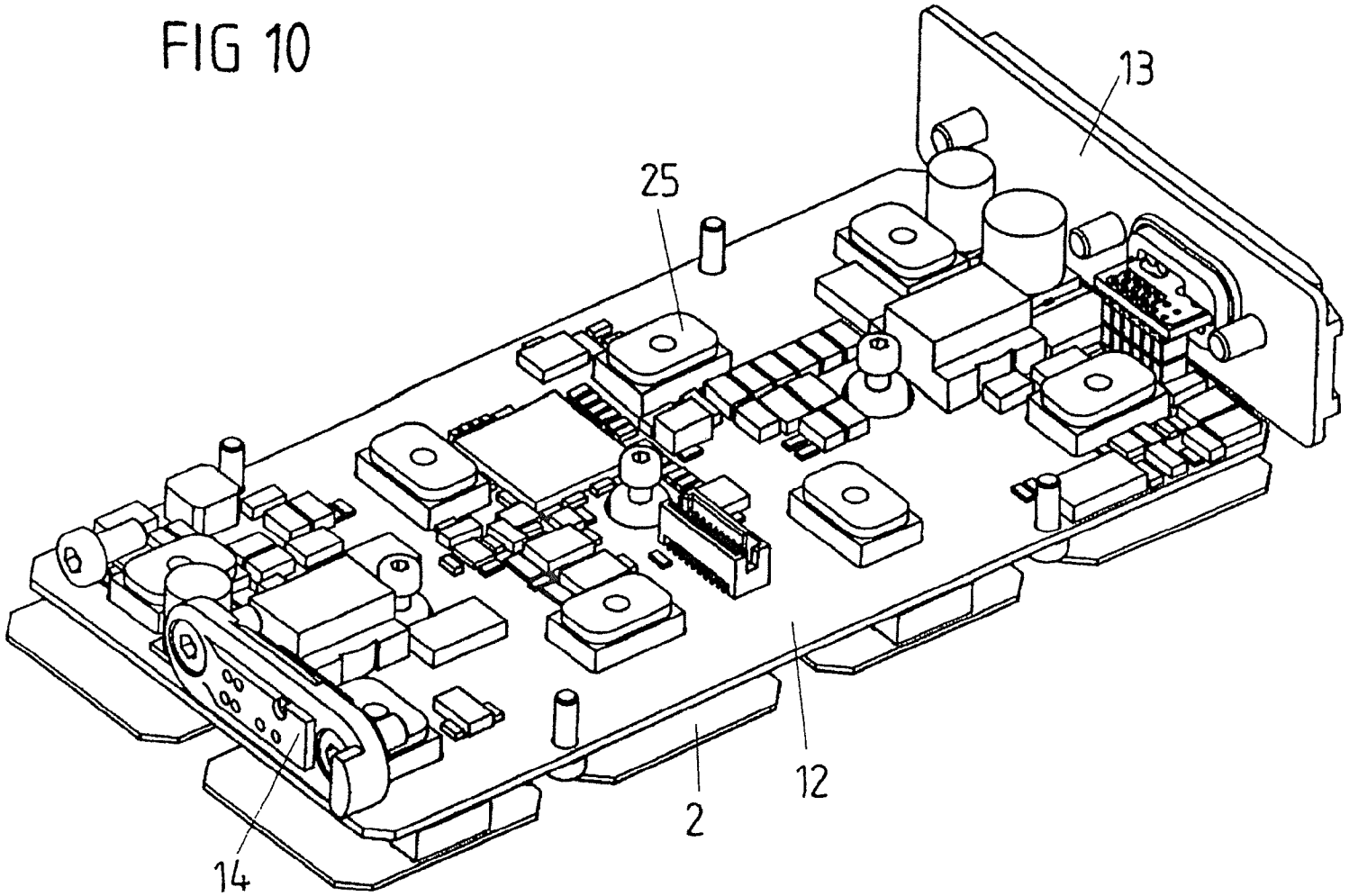
FIG. 10 shows an isometric view of the bottom surface of the equipped board of the LED panel as shown in FIG. 9.

FIGS. 9 and 10 show an isometric view of the upper and lower surface of the equipped board 12 and show the matrix-like arrangement of the lighting modules 2, the module heat sinks 25 inserted into the openings 121 of the board 12 and the connector strips 23 of the eight lighting modules 2 plugged into the sockets 122 as well as the arrangement of the mounting magnets 16 and the electronic components of the memory, control and interface elements of the LED panel 1 as well as the assignment of the input and output plug connectors 13, 14.

The board 12 is provided with eight plug connectors and eight openings 121 for the module heat sinks 25 of the eight lighting modules 2. On the board 12, the voltage supply and the interface electrode for the lighting modules 2 as well as a microprocessor for the colorimetric calculations and the convection temperature compensation are provided.

Figure 11:
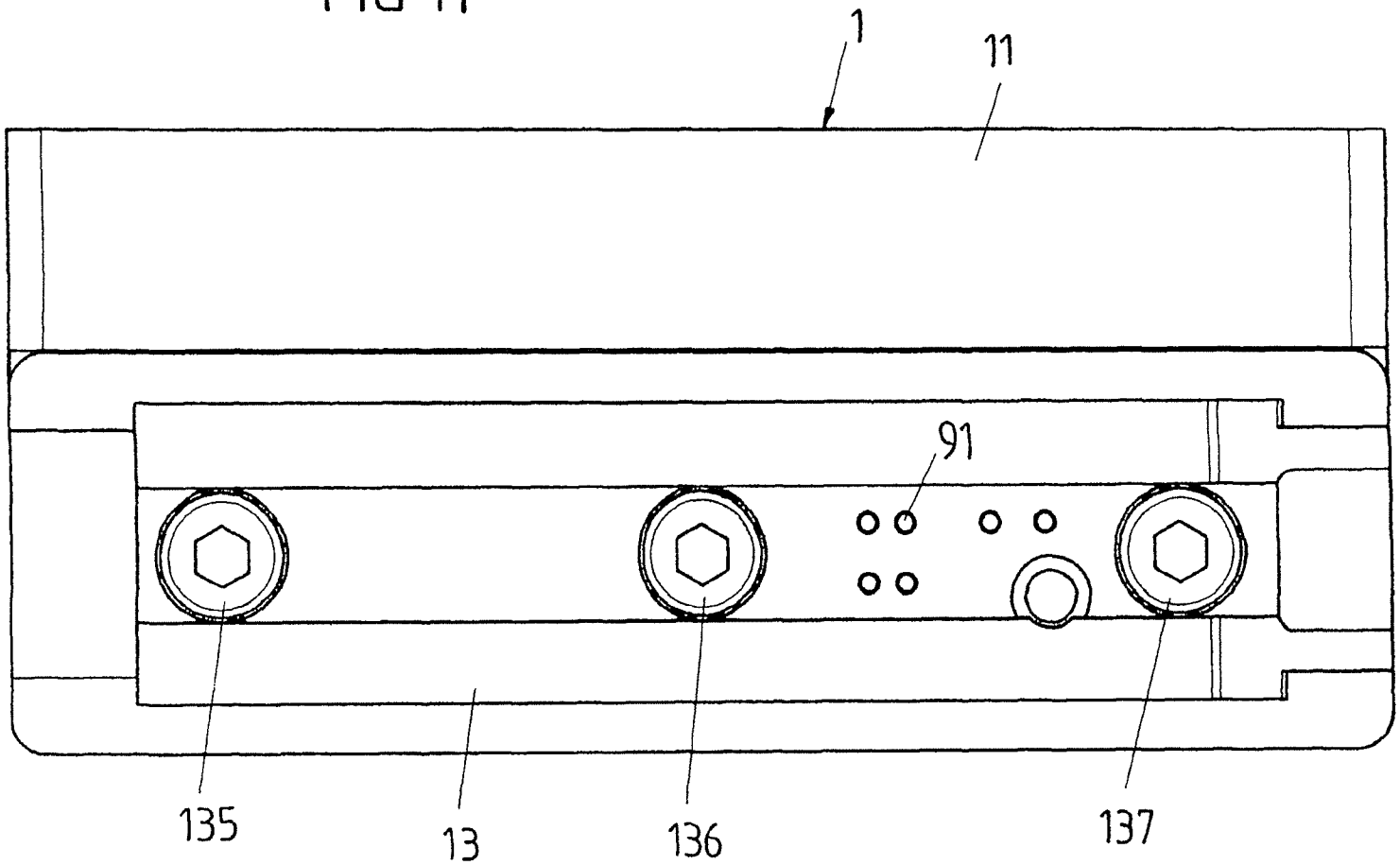
FIG. 11 shows a front view of the LED panel with an input plug connector.

FIG. 11 shows a front view of the LED panel 1 with the input plug connector 13 arranged on the narrow side of the housing frame 11, which includes a plurality of spring contact pins 91 arranged in a raster, which bounce back during connection with a further LED panel 1 or a plug and in the end position rest against flat contacts correspondingly arranged in a raster for signal transmission and power supply. The connection of the input plug connector 13 with the LED panel 1 is effected via three screws 135, 136, 137 which are connected with the housing frame 11.

Figure 12:
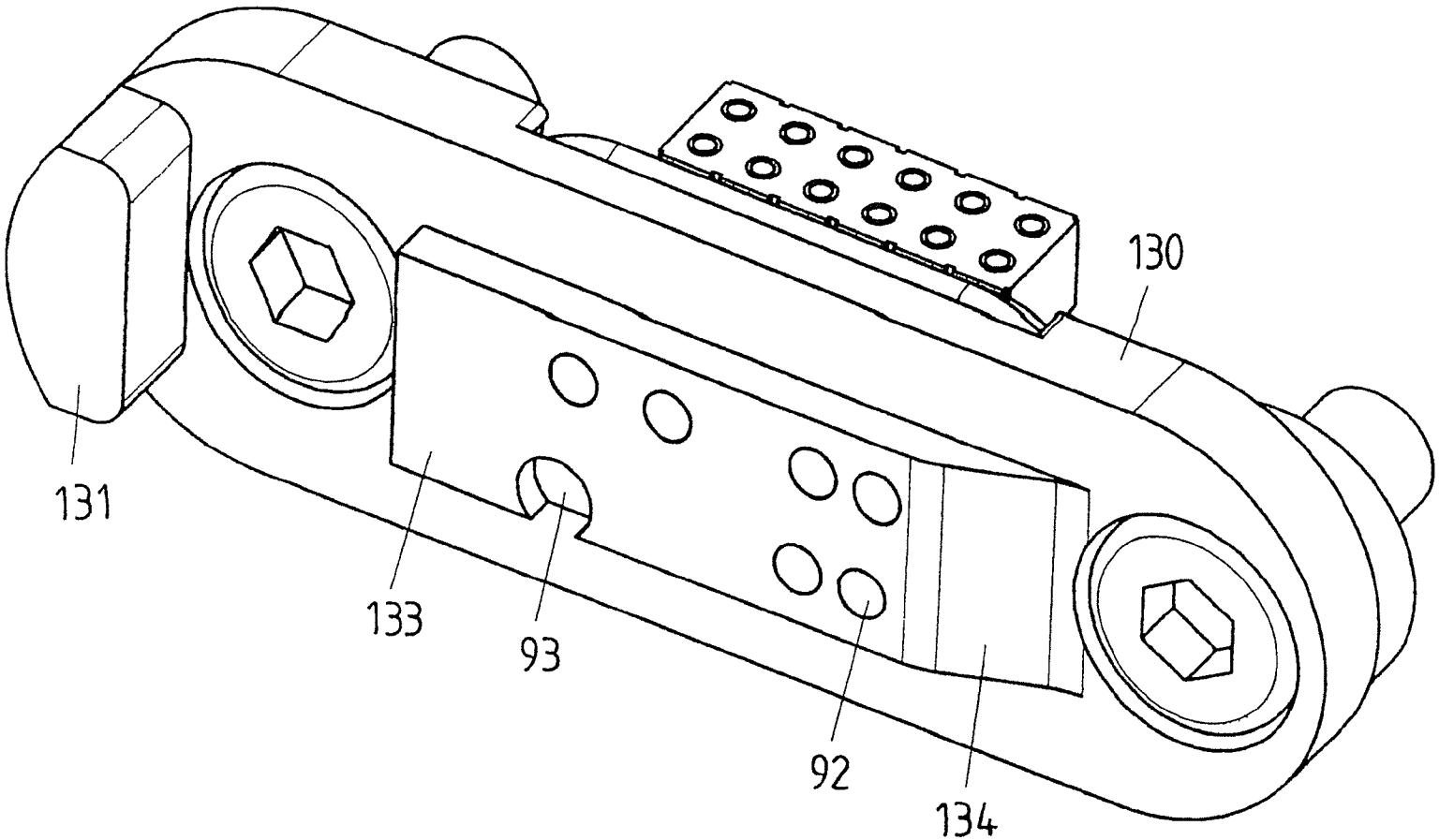
FIG. 12 shows an isometric view of an input plug connector with flat contacts.

FIG. 12 shows an isometric view of an input plug connector 13 with a base plate 130 with a ramp 133, on which flat contacts 92, a left stop 131 and a segmental bore 93 are arranged, in which the ball of a latching bolt can engage, which can optionally be connected with an LED panel 1. On the right side of the input plug connector 13 a lead-in bevel 134 can be seen, on which the spring contact pins of a counter-contact to the flat contacts 92 of the input plug connector 13 are inserted, so that they slide over the flat contacts 92 without lateral pressure.

Figure 13:
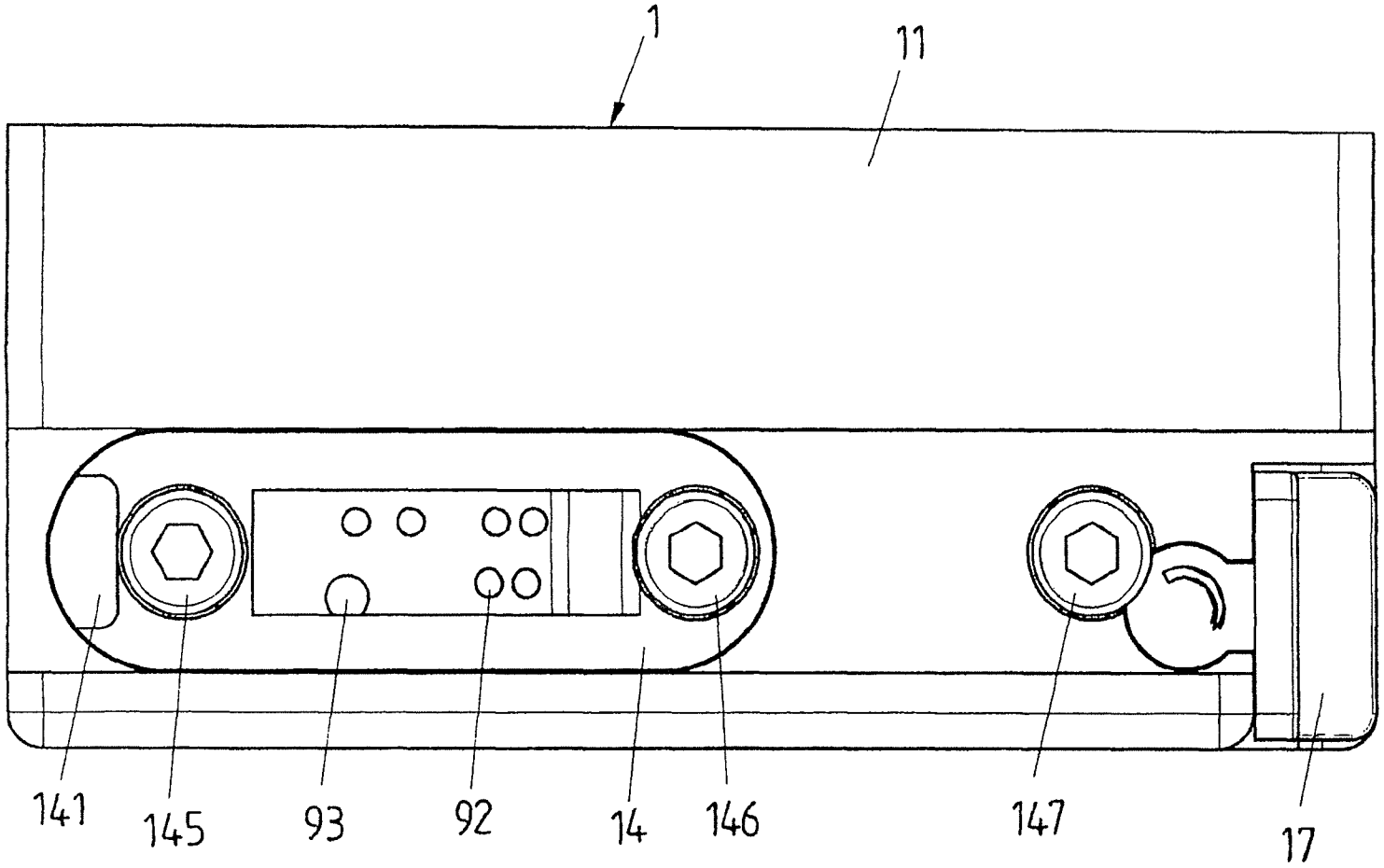
FIG. 13 shows a rear view of the LED panel with an output plug connector.

FIG. 13 shows a rear view of the LED panel 1 with the output plug connector 14 arranged on the other narrow side of the housing frame 11 and the slide 17 for unlocking the counter-contact. The output plug connector 14 includes a plurality of flat contacts 92, a segmental bore 92, in which the ball of a latching pin can engage, which optionally can be connected with an LED panel 1, and a left stop 141. Via three screws 145, 146, 147 the output plug connector 14 is connected with the housing frame 11 of the LED panel 1.

Figure 14:
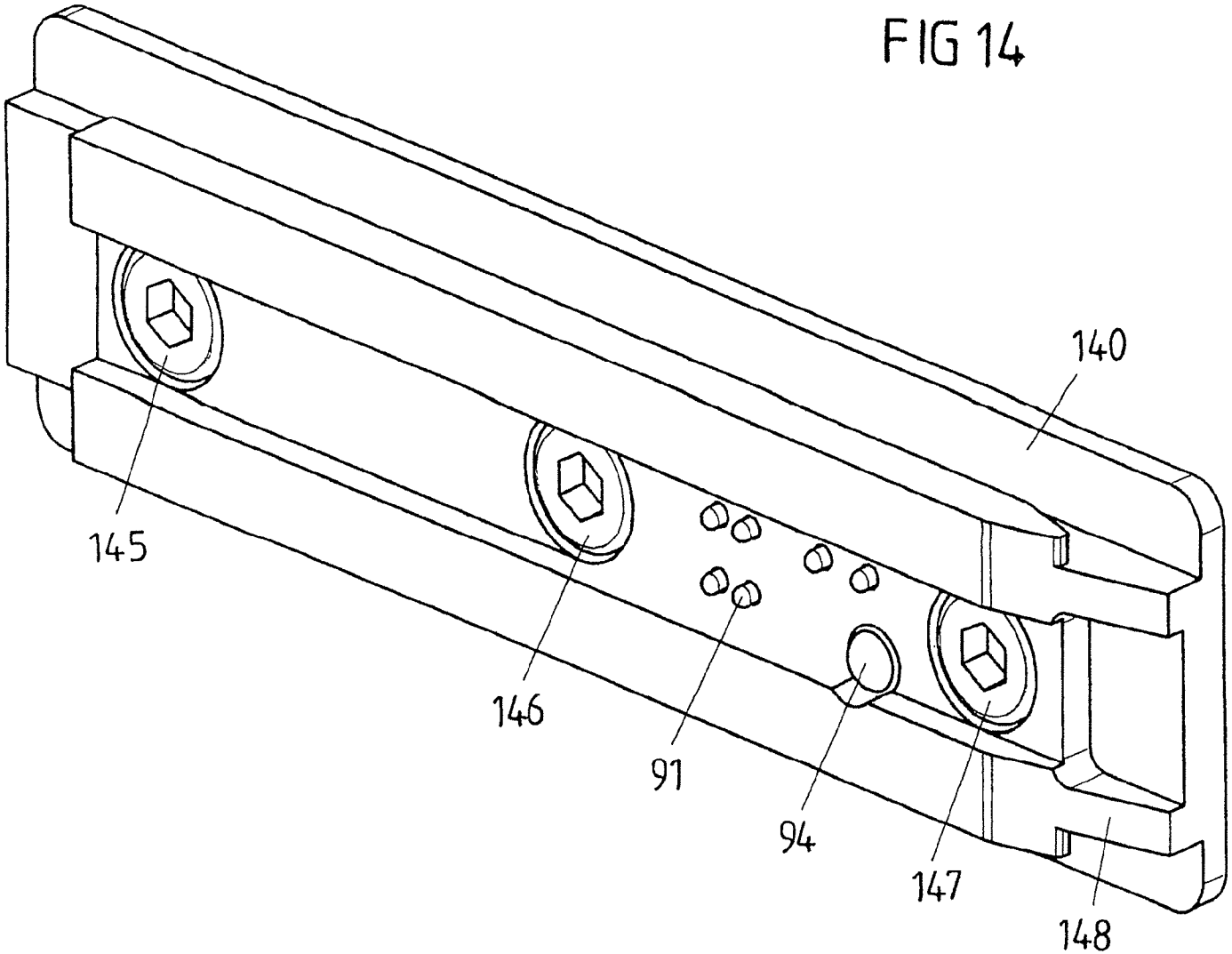
FIG. 14 shows an isometric view of an output plug connector.

In an isometric representation, FIG. 14 shows a long version of an output plug connector 140 with a spherical latching bolt 94 arranged in the right-hand terminal region and a lead-in bevel 148 of the T-shaped groove connection as well as a plurality of spring contact pins 91 arranged in a raster for signal transmission and power supply as well as three screws 145, 146, 147 with which the output plug connector 14 can be connected with the housing frame 11 of the LED panel 1, a connecting plug or the power supply and docking station 5.

In FIGS. 15 to 20 embodiments for optical devices are shown, which can be placed on top of the light-radiating upper surface of the LED panel 1 and depending on the desired radiation characteristic are formed as soft optic 3 or as spot optic 4.

Figure 15:
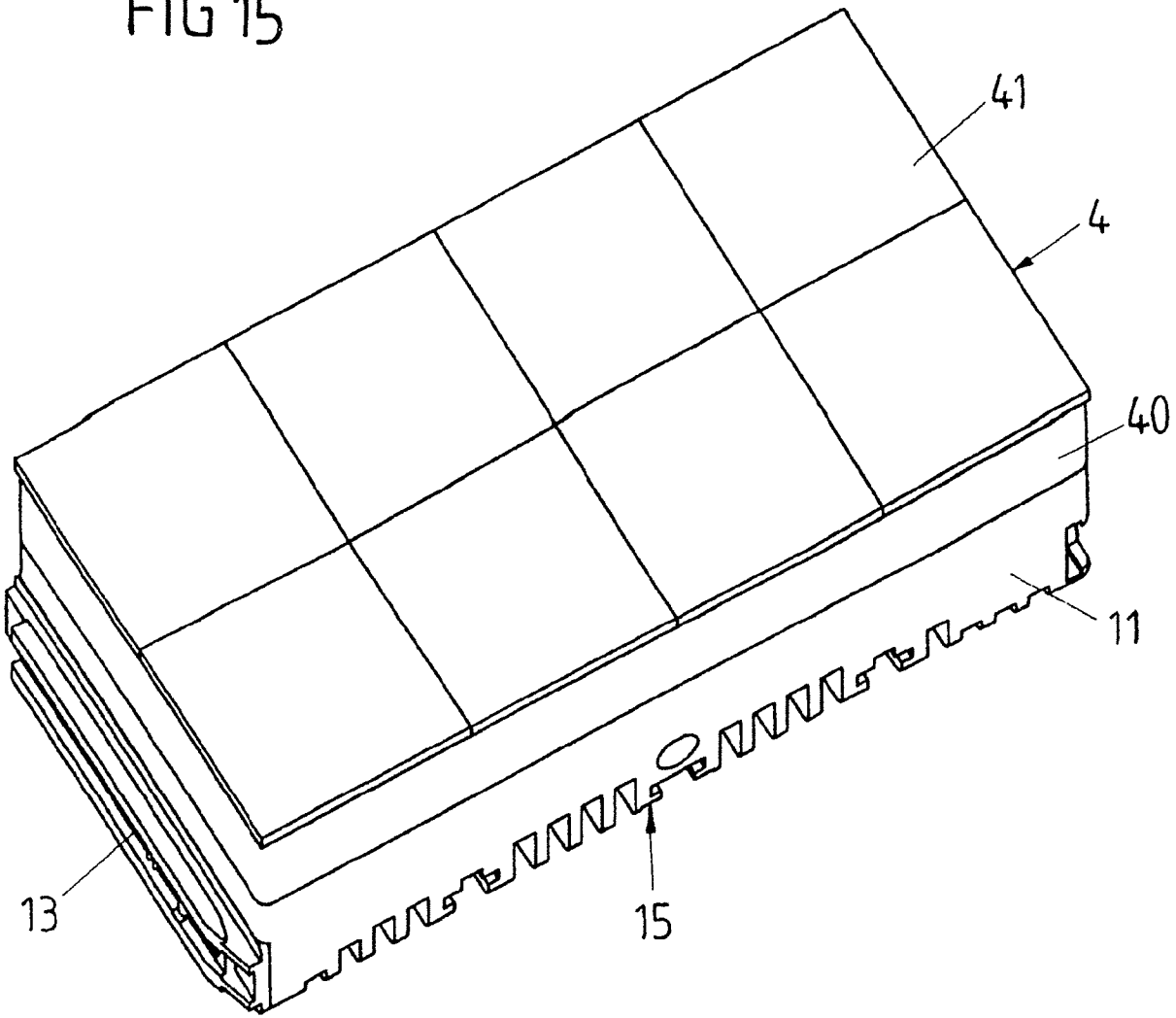
FIG. 15 shows an isometric view of an LED panel with a spot optic.

FIG. 15 shows an LED panel 1 with a spot optic 4 in an isometric view. The spot optic 4 connected with the upper surface of the LED panel 1 has a frame 40 on whose upper surface condenser plates 41 are arranged, which mix the light emitted by the light sources 21 of the lighting modules 2 via TIR lenses 42 arranged below the same, which are shown in the isometric view of FIG. 15 and in a side view of FIG. 16. In the illustrated embodiment, the height of the modular spot optic 4 is 22 mm and includes a half-peak angle of 18°.

Figure 16:
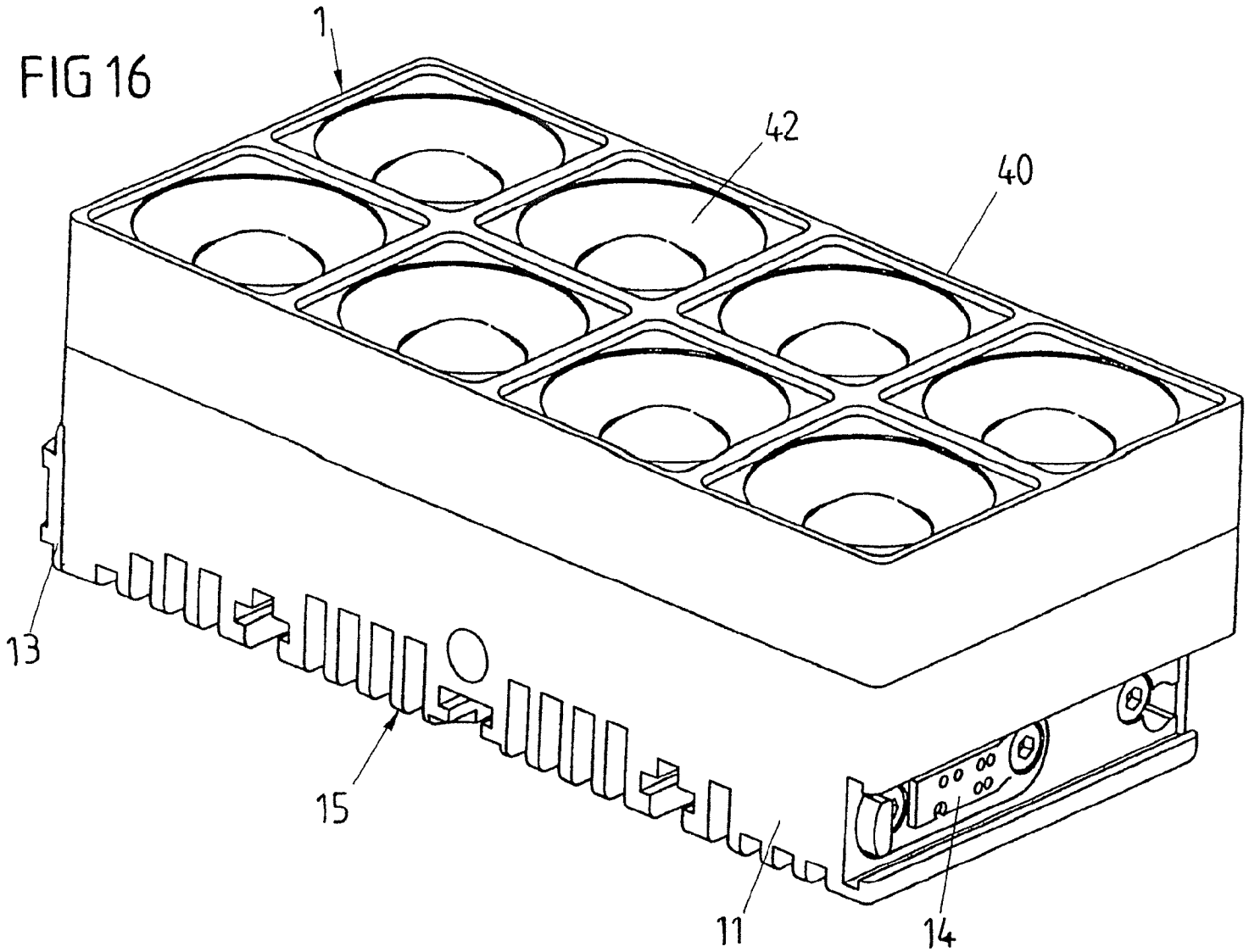
FIG. 16 shows an isometric view of an LED panel with a spot optic.
Figure 17:
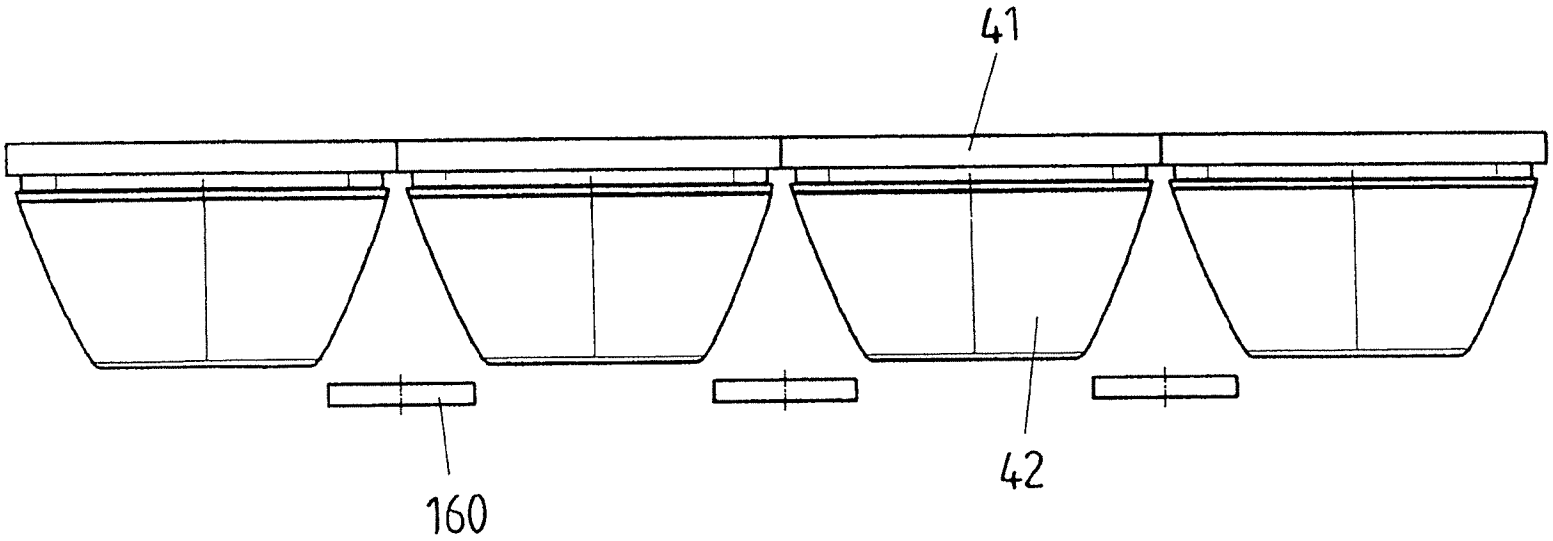
FIG. 17 shows a side view of the spot optic of FIGS. 15 and 16 without an optic housing.
Figure 18:
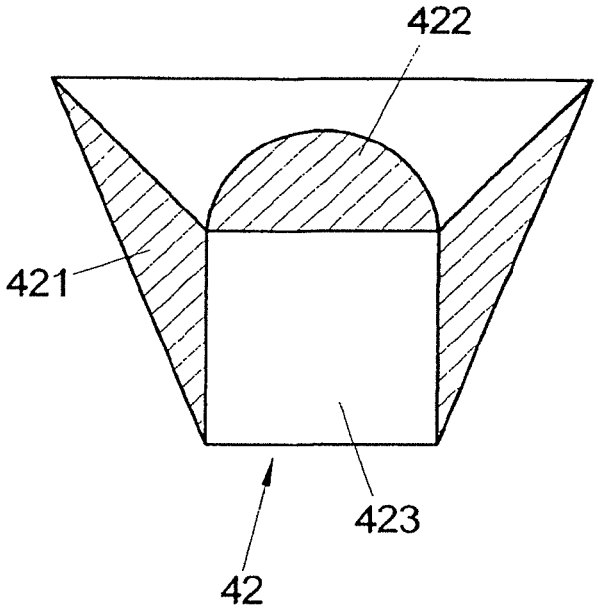
FIG. 18 shows a section through a TIR lens of the spot optic.

In FIG. 16, the matrix-like arrangement of the TIR lenses 42 associated to the individual lighting modules of the LED panel 1 is shown in an isometric view, which TIR lenses are shown in FIG. 17 in a side view without housing. The TIR lenses 42 consist of a plurality of spherical lenses and have the shape shown in FIG. 18 in a longitudinal section with a cup-shaped lens part 421 provided with a central bore 423 and with a hemispherical lens part 422.

The side view of the spot optic 4 without housing as shown in FIG. 17 reveals the condenser plates 41 of FIG. 15 above the TIR lenses 42, thereunder the TIR lenses 42 and below the TIR lenses 42 three iron disks 160, which serve as counterparts to the mounting magnets 16 of the LED panel 1 for connecting the spot optic 4 with the LED panel 1. The TIR lenses 42 are located about 5 mm above the LEDs of the lighting modules of FIG. 7 which are combined to a light source.

Figure 19:
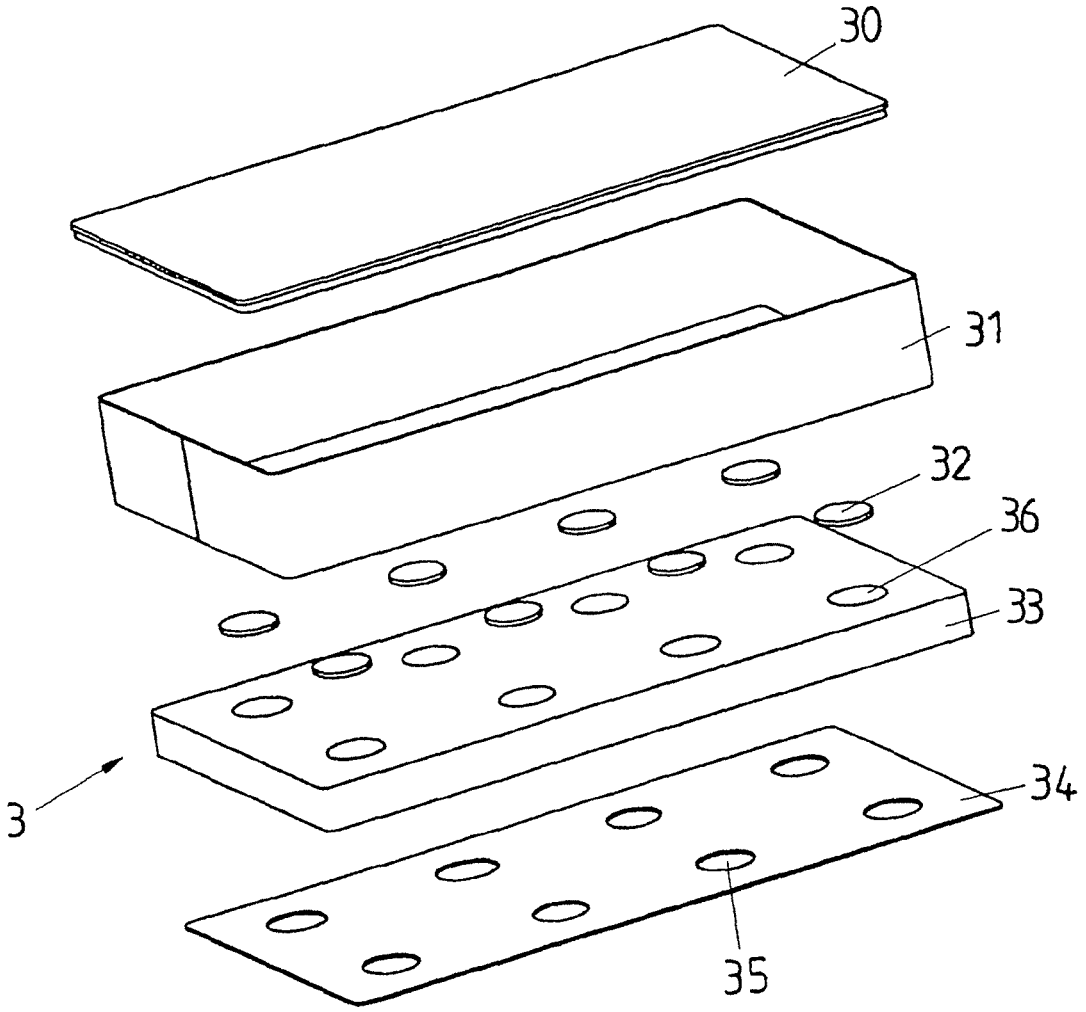
FIG. 19 shows an isometric exploded view of a soft optic.
Figure 20:
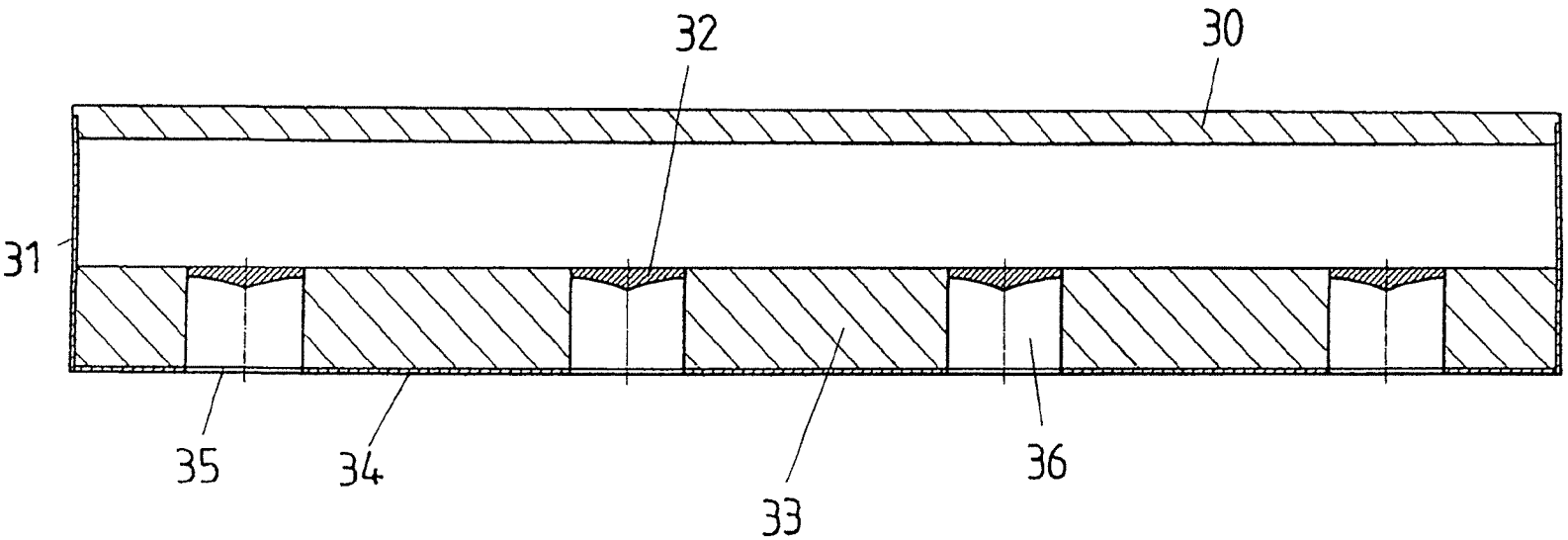
FIG. 20 shows a longitudinal section through the soft optic of FIG. 19.

In FIGS. 19 and 20 a soft optic 3 connectable with the LED panel 1 is shown in an isometric exploded representation and in a longitudinal section and is composed of a diffusely reflecting plate 30, which terminates a housing frame 31 of the soft optic 3 to the top, and a light scattering plate 33 of polymethyl methacrylate (PMMA) or polycarbonate (PC) with reflectors 32 arranged therein, which are inserted in openings 36 of the light scattering plate 33, into which the light radiated by the LEDs 22 of the light source 21 of the lighting modules 2 is coupled. The light scattering plate 33 is mirrored on the sides and on the bottom surface for optimum reflection of the light emitted by the LEDs 22, for which purpose a mirror plate 34 with openings 35 arranged on the bottom surface of the light scattering plate 33 is provided at the points of the openings 36 of the light scattering plate 33. For optimization of the light scatter, the light scattering plate 33 made of PMMA or PC can additionally be structured on the upper and lower surfaces, for example in the form of alternating grooves and elevations.

With equal light emission of the individual LEDs of the LED panel 1, the light scattering plate 33 with the openings 36 provided therein and the reflectors 32 inserted therein can be omitted in the soft optic 3, since in this case mixing the light emitted by the LEDs no longer is required in the soft optic 3. In this case, the soft optic 3 preferably only consists of a highly mirrored sheet metal housing and of the diffusely reflecting plate 30, which is attached to the LED panel 1 in particular by means of magnets glued onto the bottom inside the sheet metal housing.

Figure 21:
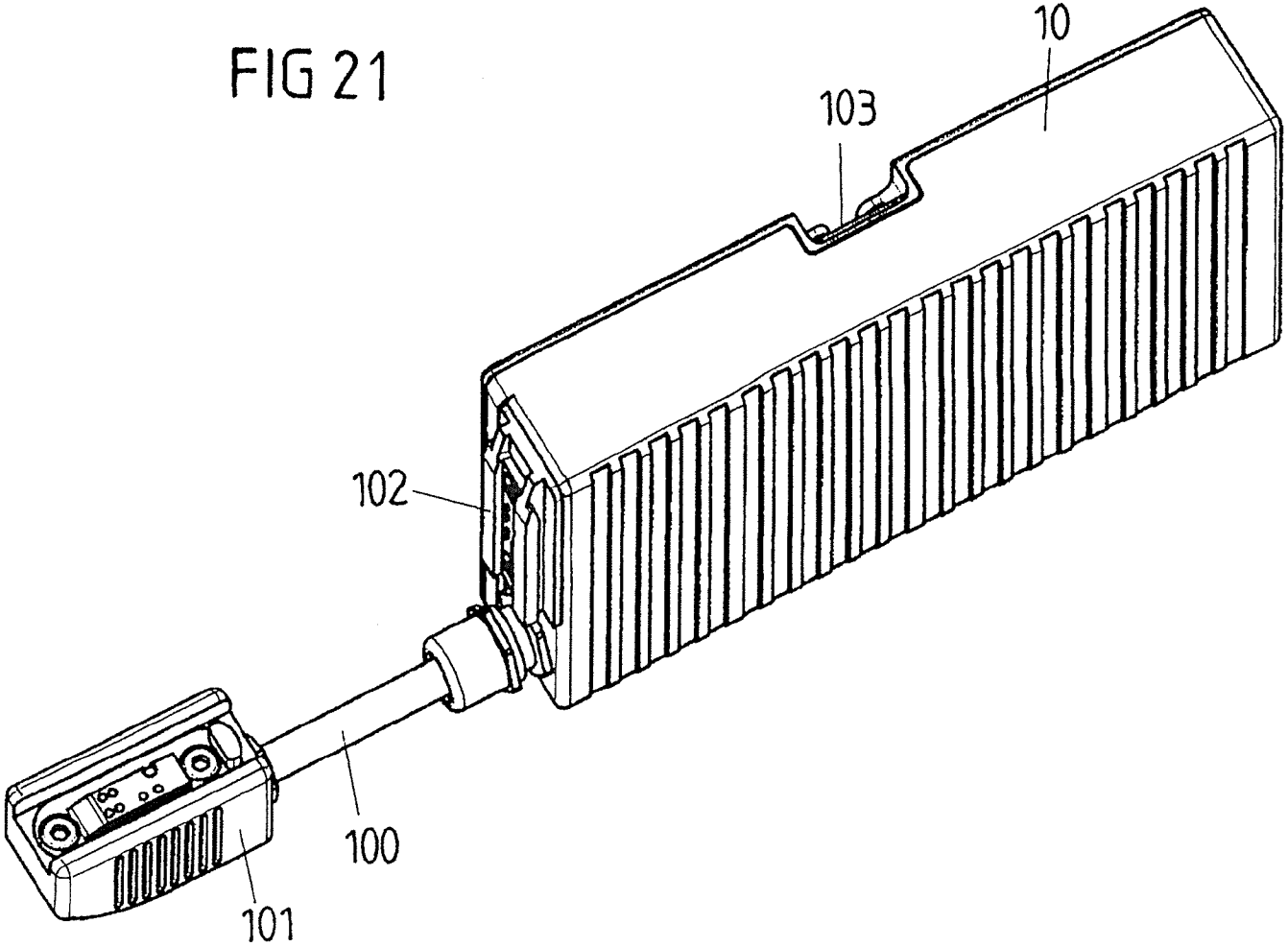
FIG. 21 shows an isometric view of an accumulator with charging circuit for an LED panel.

For the mains-independent power supply of one or more LED panels 1, there is used an accumulator 10 with integrated charging electronic shown in FIG. 21 in an isometric view is used, which via a cable end 100 with an output plug connector 101 can be connected to an LED panel 1 or for charging via an input plug connector 102 can be docked to the power supply and docking station 5. On the bottom surface of the accumulator 10 a pocket 103 for accommodating a connecting element is provided, with which the accumulator 10 can be plugged to the heat sink of an LED panel 1 in the same manner as a connecting pin and can be engaged therein.

Figure 22:
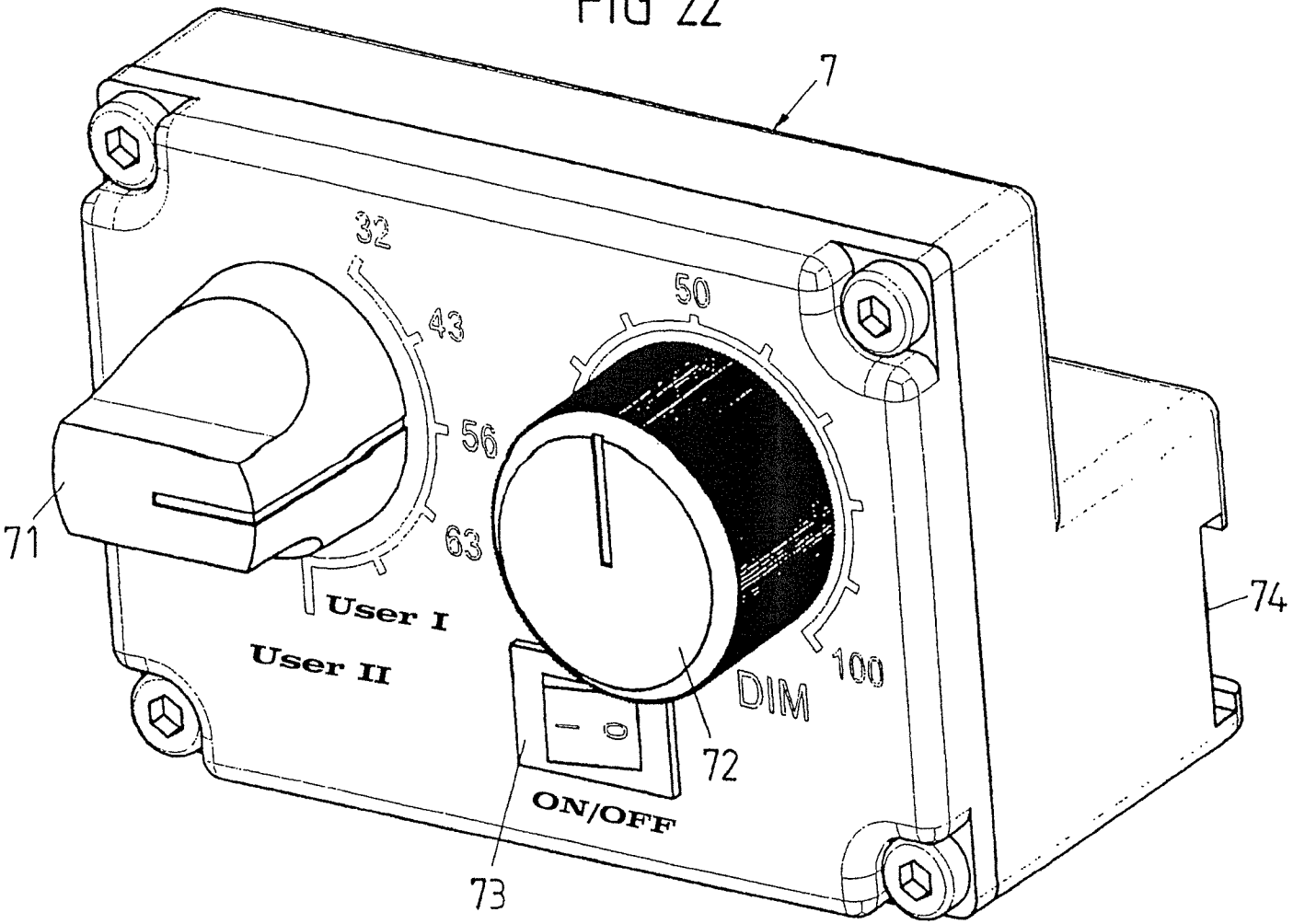
FIG. 22 shows an isometric view of a decentralized control element for attachment to an LED panel.
Figure 23:
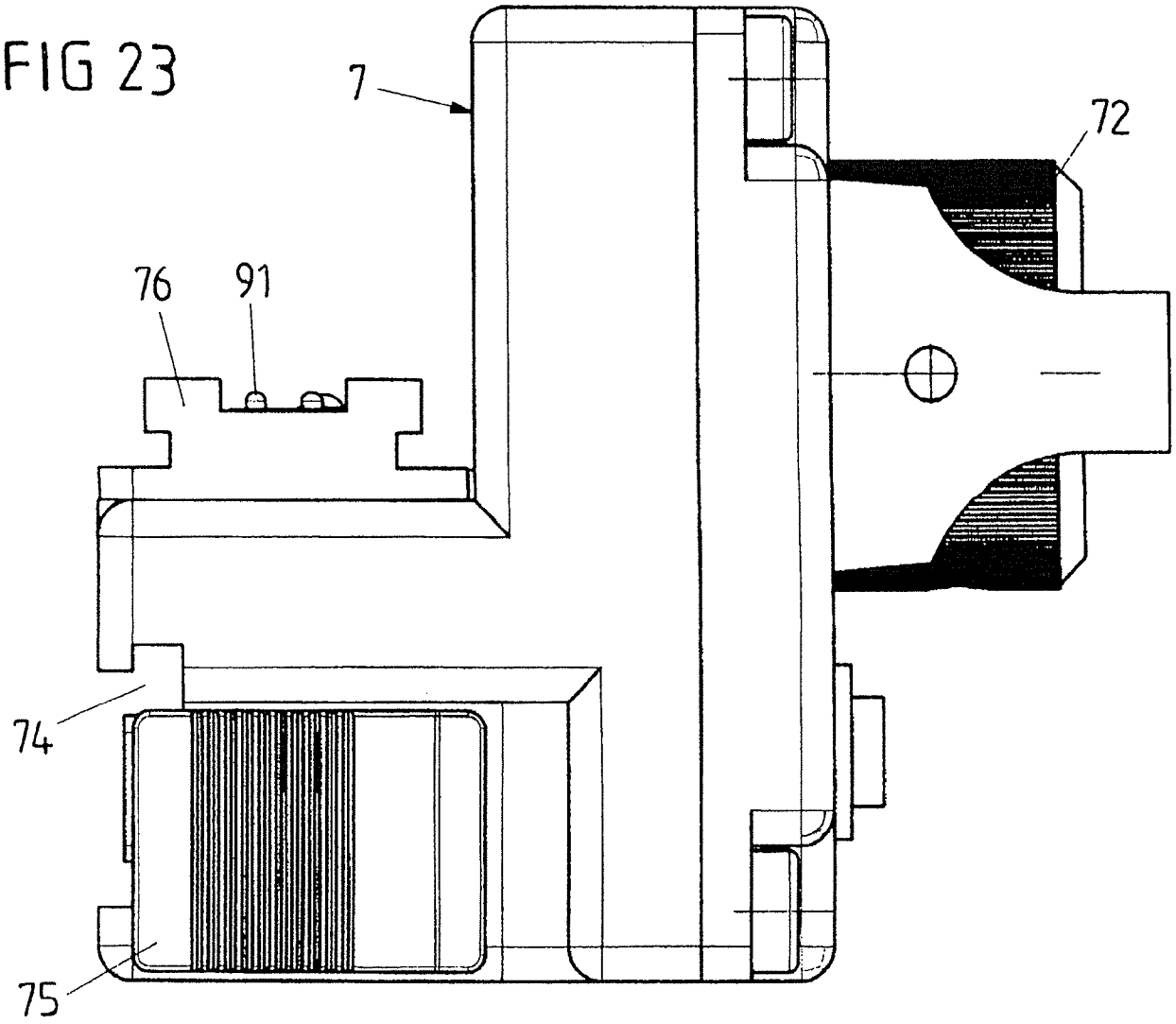
FIG. 23 shows a side view of a decentralized control element for attachment to an LED panel.
Figure 24:
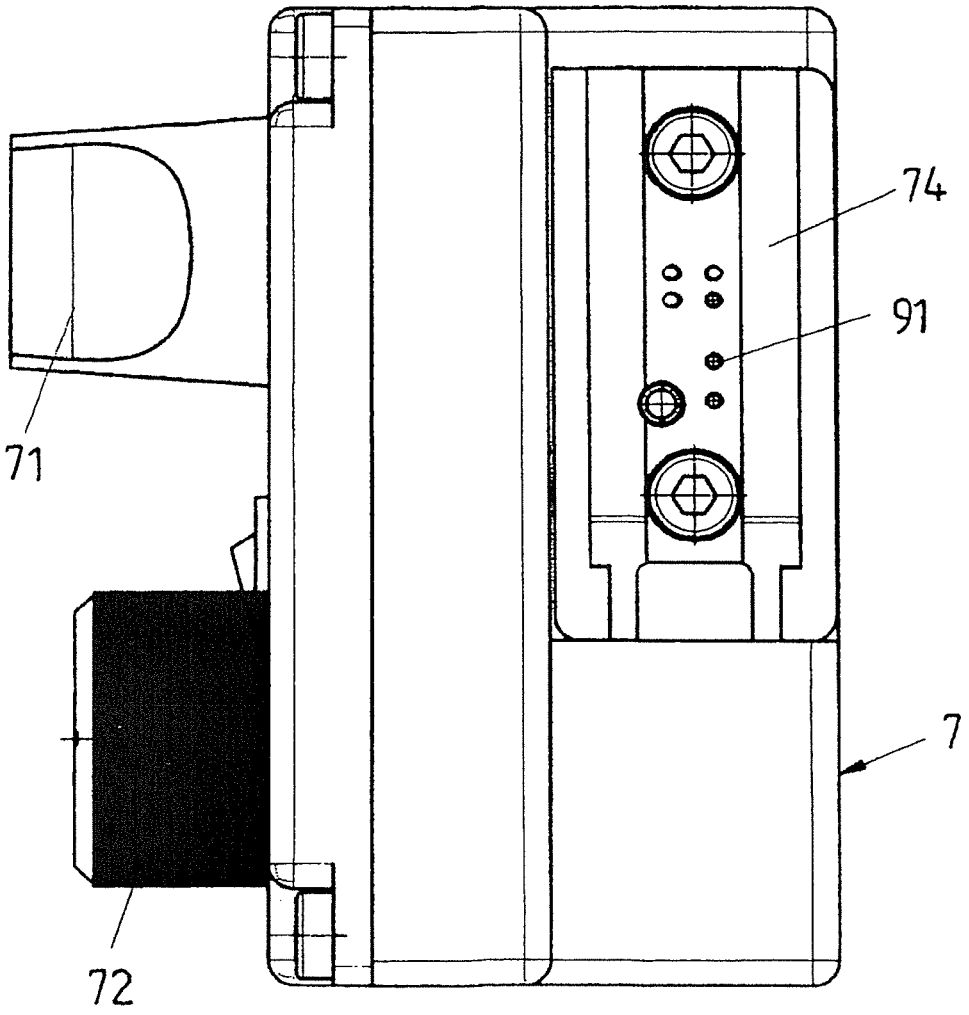
FIG. 24 shows a top view of a decentralized control element for attachment to an LED panel.

The decentralized control element 7 shown in FIGS. 22 to 24 for plugging to an LED panel 1 serves to adjust fixed or user-preprogrammed light colors (presets) and the brightness of the light emitted by the LED panels 1. In general, the decentralized control element 7 is plugged off from the respective LED panel 1 upon adjustment, whereas the LED panel 1 with the adjusted color and brightness still emits light. When a plurality of LED panels are connected to an LED panel group, the decentralized control element 7 controls all LED panels which are electrically arranged behind the same.

Corresponding to the isometric view shown in FIG. 22, the decentralized control element 7 on the left includes a preset selector switch 71 with four fixed settings for different light colors (3200 K, 4300 K, 5600 K and 6300 K) and two settings (User I and User II) to be programmed by a user, and on the right a dimmer 72 with a dimming range from 0 to 100% and below the same an on/off switch 73. The side view and the top view of the decentralized control element 7 as shown in FIGS. 23 and 24 each reveal an output plug connector 74 with a latch 75 for unlocking the counter-contact and an input plug connector 76 with spring contact pins 91, which has been accommodated at this point to provide sufficient space for the large, front-side operating elements 71 to 73. In this way, the setting can be varied from all positions of the user.

Instead of the preset selector switch 71 and dimmer 72 protruding from the surface of the control element 7, which are shown in FIGS. 22 to 24, the decentralized control element 7 to be plugged onto an LED panel 1 or an LED panel group 1' instead of a radio module can include flush-mounted rotary knobs which prevent an adjustment by mistake.

Figure 25:
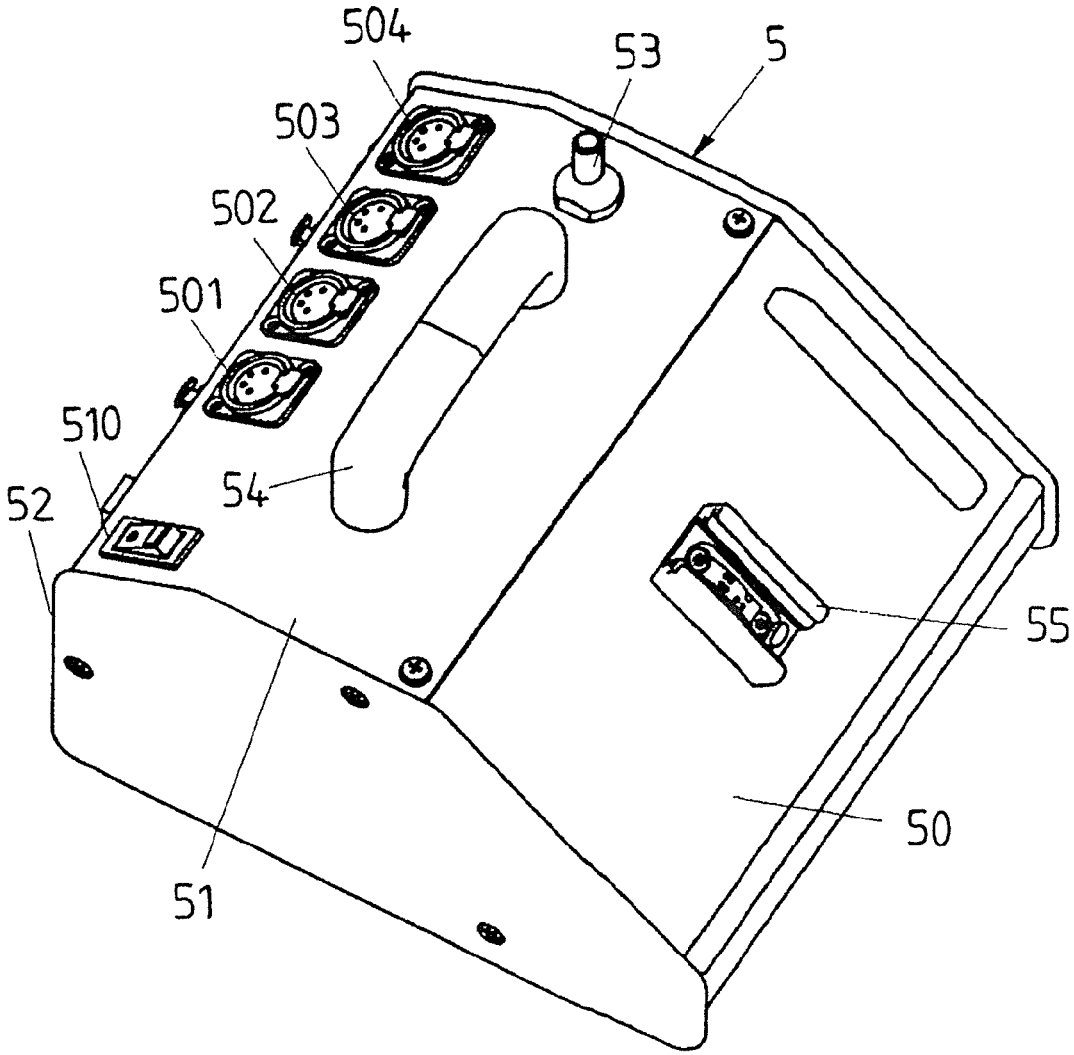
FIG. 25 shows an isometric view of a power supply and docking station of a central power control unit.
Figure 26:
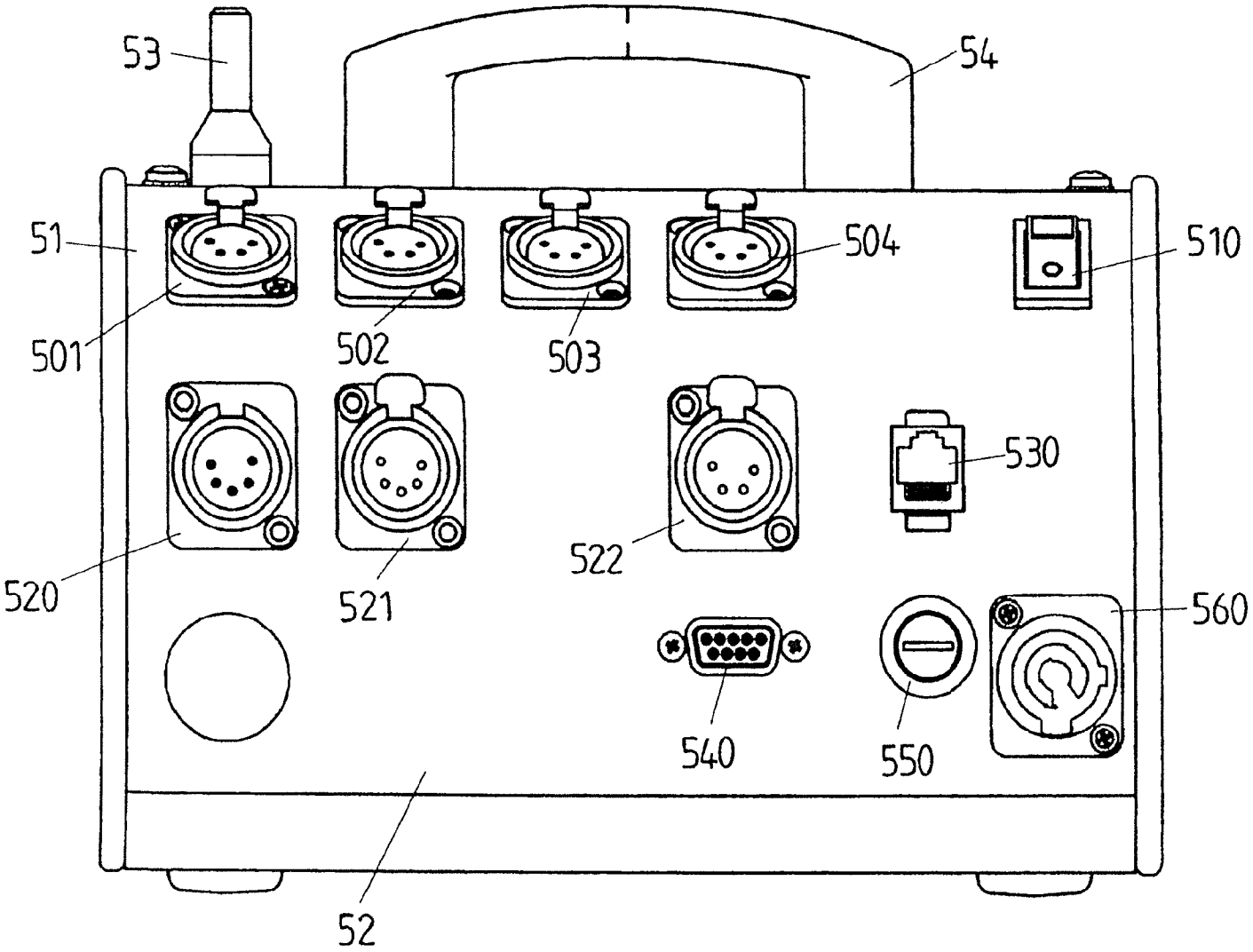
FIG. 26 shows a rear view of a power supply and docking station of a central power control unit.
Figure 27:
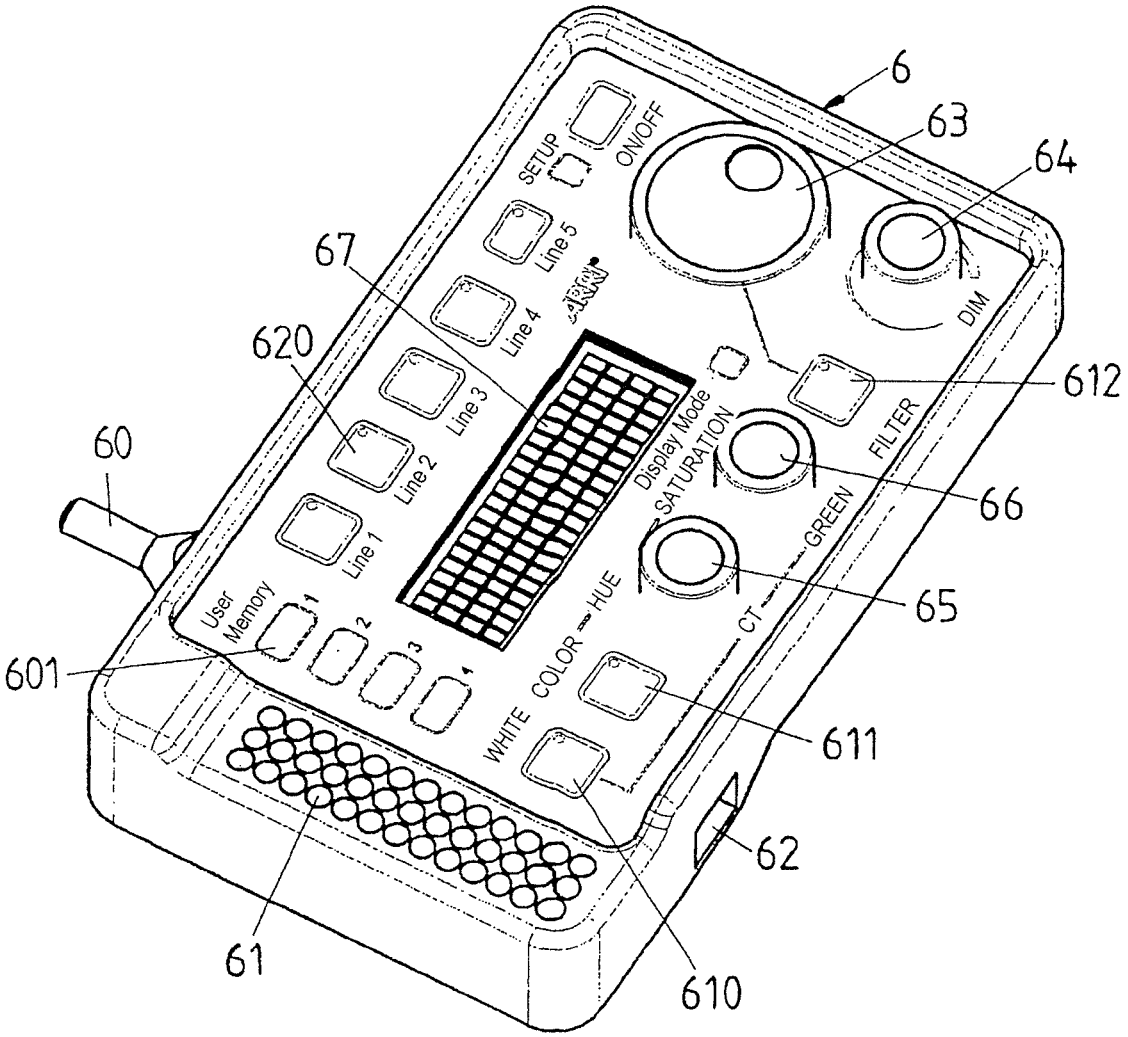
FIG. 27 shows an isometric view of a control device of the central power control unit, which is electrically and/or mechanically connectable with the power supply and docking station.
Figure 28:
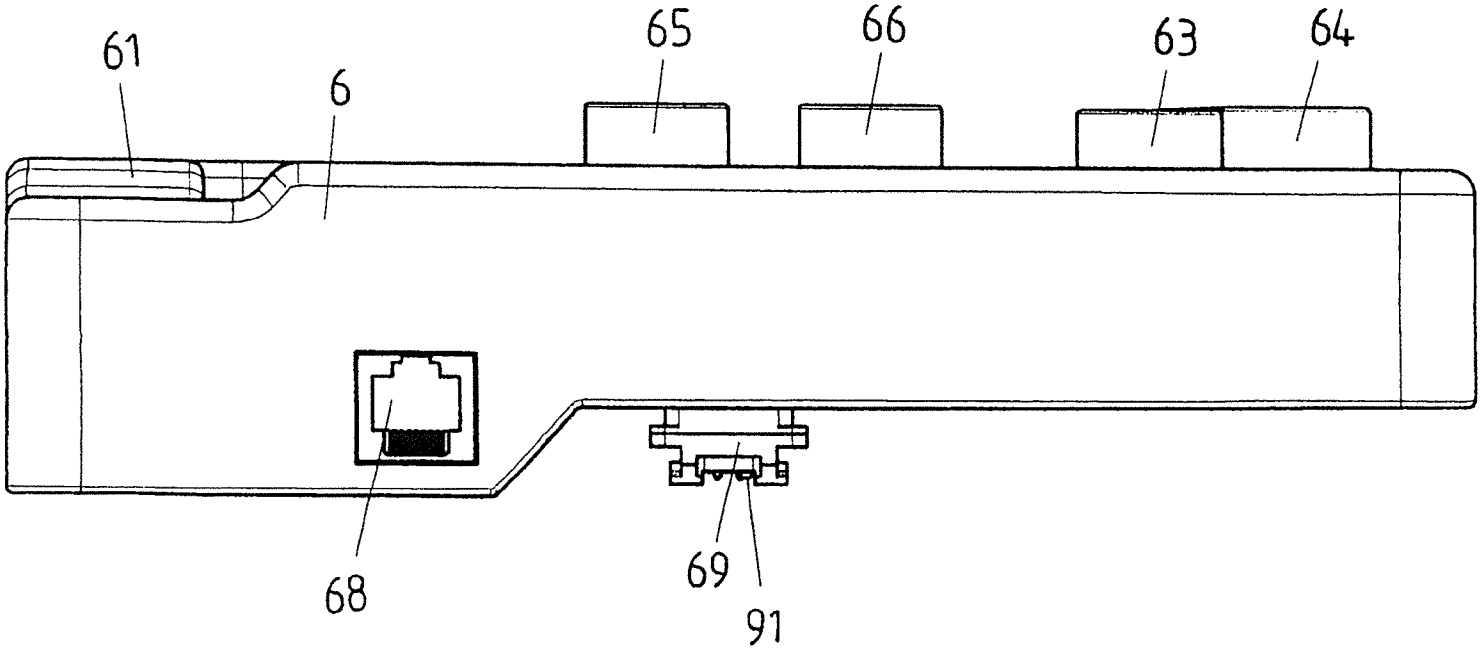
FIG. 28 shows a front view of a control device of the central power control unit, which is electrically and/or mechanically connectable with the power supply and docking station.

In a consequent continuation of the modular design of the lighting system, the central power control unit 5, 6 is composed of the power supply and docking station 5 shown in FIG. 25 in an isometric view and in FIG. 26 in a rear view and of the control device 6 shown in FIG. 27 in an isometric view and in FIG. 28 in a front view.

On an angled portion of the upper surface 51 of the housing of the power supply and docking station 5, the power supply and docking station 5 includes four output sockets 501 to 504 for four lines of lighting modules or LED panels and an on/off switch 510. In the center of the upper surface 51 beside a handle 54 a radio antenna 53 is arranged and on a front-side inclined surface 50 of the power supply and docking station 5 an output plug connector 55 with flat contacts to the control device 6 is provided, so that a corresponding input plug connector of the control device 6 can be engaged into the output plug connector 55 arranged on the inclined front side of the power supply and docking station 5. In this way, a tabletop operating device is formed, whereas with a separate arrangement of the control device 6 and the power supply and docking station 5 a radio control to the power supply and docking station 5 or alternatively via a cable connection a cable control to the power supply and docking station 5 can be effected.

The power supply and docking station 5 represents the central power supply and communication device for the entire lighting system.

The rear side 52 of the power supply and docking station 5 illustrated in FIG. 26 shows the four sockets 501 to 504 to the lighting modules of the LED panels in the upper row, a DMX input and output socket 520 for remote control, charging sockets 521, 522 for charging accumulators, and a network socket 530 in the middle row, while in the lower row an RS232 programming interface 540, a fuse 550 as well as a mains input socket 560 are arranged. On the lower left, a cover is provided, below which further service interfaces such as USB interfaces, serial interfaces and Ethernet interfaces are located.

In the isometric view of FIG. 27, the control device 6 selectively connectable with the power supply and docking station 5 via a radio connection or via a cable connection shows a radio antenna 60 for the radio connection to the power supply and docking station 5, a handle surface 61, a socket 62 for a cable connection and a plurality of keys and rotary knobs explained below for setting various nominal values and parameters as well as a display 67.

The control device 6 serves the comprehensive adjustment and programming of the lighting modules of the LED panels, wherein the control device 6 itself has comparatively little intelligence and substantially serves to exchange keyboard commands, rotary knob positions and the data to be displayed on the display 67 with the power supply and docking station 5. The actual computing power for the colorimetry and the operation of the communication interfaces is assigned to the power supply and docking station 5 as well as the microcontrollers and microprocessors of the lighting modules 2. The control device 6 has an autonomous power supply by means of accumulators and an integrated charging circuit.

The isometric view of FIG. 27 shows four user memory locations 601 for color settings, four output selection keys 620 for the connection to various LED panels, the centrally arranged LCD display 67, a menu rotary knob 63 with push function, an operating mode selection key 610 (WHITE) for film lighting, an operating mode selection key 611 (COLOR) for colored effect lighting, and an operating mode selection key 612 (FILTER) for digitally stored, customary color filters. Furthermore, a dimmer (DIM) 64 and controller 65, 66 for the color temperature (CT) and the green value (GREEN) in the WHITE mode and for the color tone (HUE) and the saturation (SAT) in the COLOR mode are provided.

The front view shown in FIG. 28 represents an RJ45 socket 68 for connection of a commercially available network cable as emergency connection to the power supply and docking station 5, when a radio connection is not possible or the radio connection fails. In the center, a spring contact connection 69 with spring contact pins 91 to the power supply and docking station 5 is shown, via which the control device 6 is docked to the power supply and docking station 5.

Figure 29:
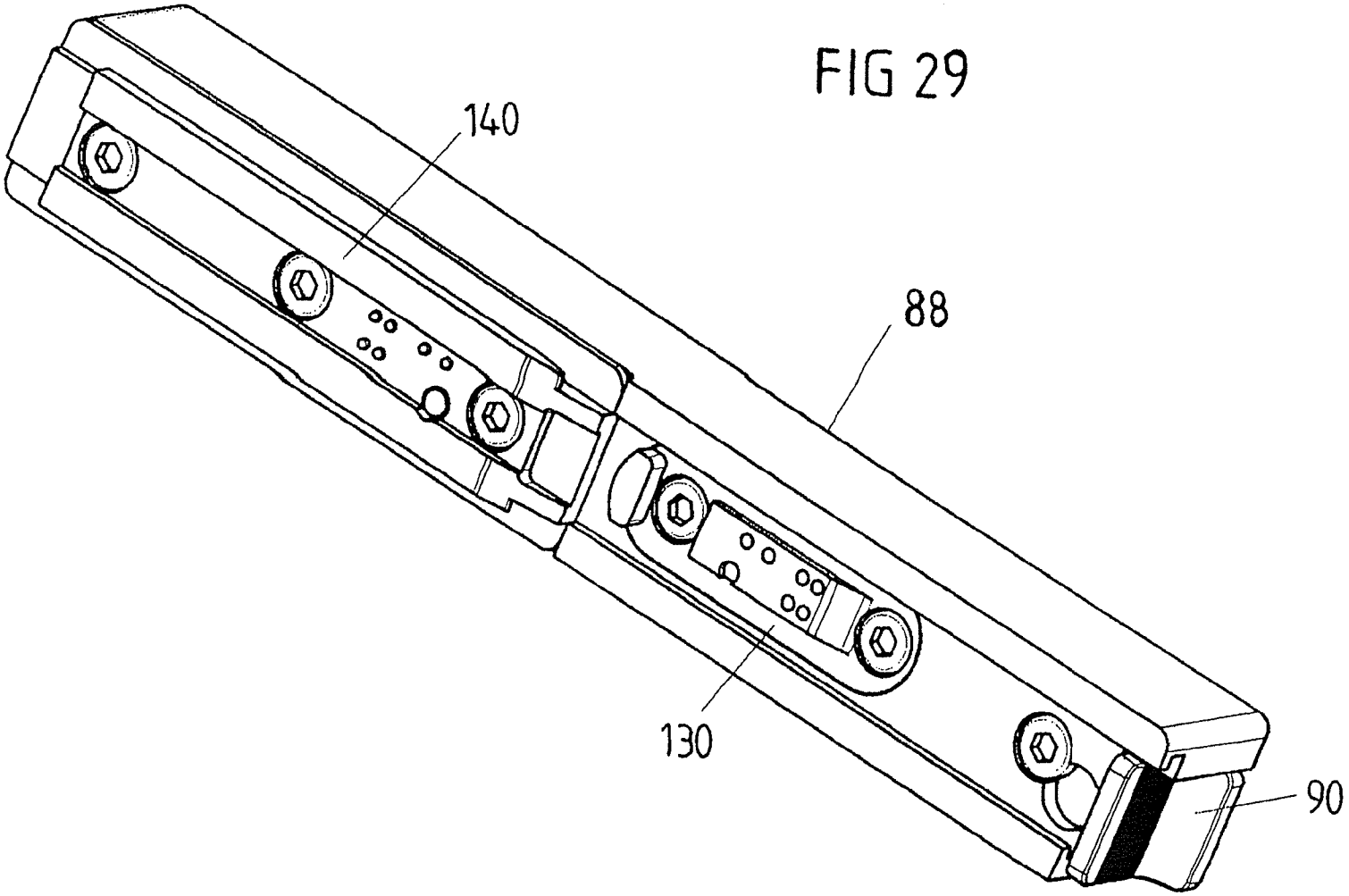
FIG. 29 shows an isometric view of an electromechanical cross connector for forming larger luminous areas made of two or more LED panels.

For a cross-connection of a plurality of LED panels connected with each other in rows via plug connectors corresponding to the connection of the LED panel group 1' of FIG. 1, an electromechanical cross connector 9 shown in FIG. 29 in an isometric view is used, by means of which larger luminous areas can be formed from two or more LED panels. The electromechanical cross connector 9 contains panel-compatible input and output plug connectors 130, 140 with a lock 90. Due to the size of the individual LED panels 1 of e.g. 160×80 mm, expedient combinations of luminous areas made of four or more LED panels can be generated by means of the cross connector 9. Without a cross connector 9 as shown in FIG. 28, a strip or a row of two to four LED panels with the dimensions 80×230/480/640 mm thus can be formed, whereas with a cross connector 9 a square luminous area of 160×160 mm or a rectangular luminous area of 160×320 mm can be formed.

Figure 30:
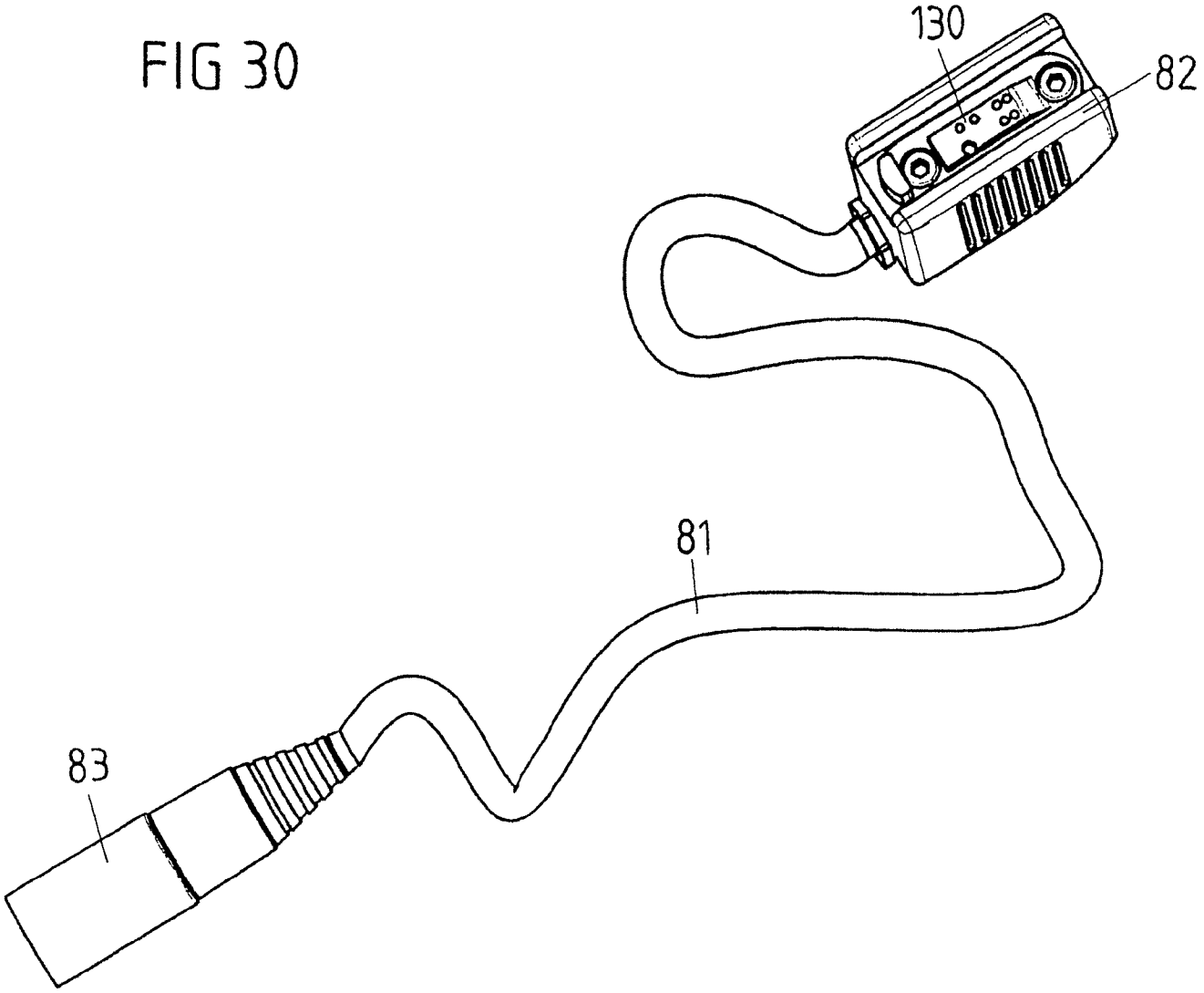
FIG. 30 shows a perspective representation of a connecting cable for connecting the central power control unit with the lighting modules of an LED panel.

FIG. 30 shows a connecting cable 81 for connection of the power supply and docking station 5 with the LED panels 1, which at its one end is provided with a plug 83 for connection with the sockets of the power supply and docking station 5 and at its other end is provided with a plug connector 82 corresponding to the plug connector with stop as shown in FIG. 12.

Figure 31:
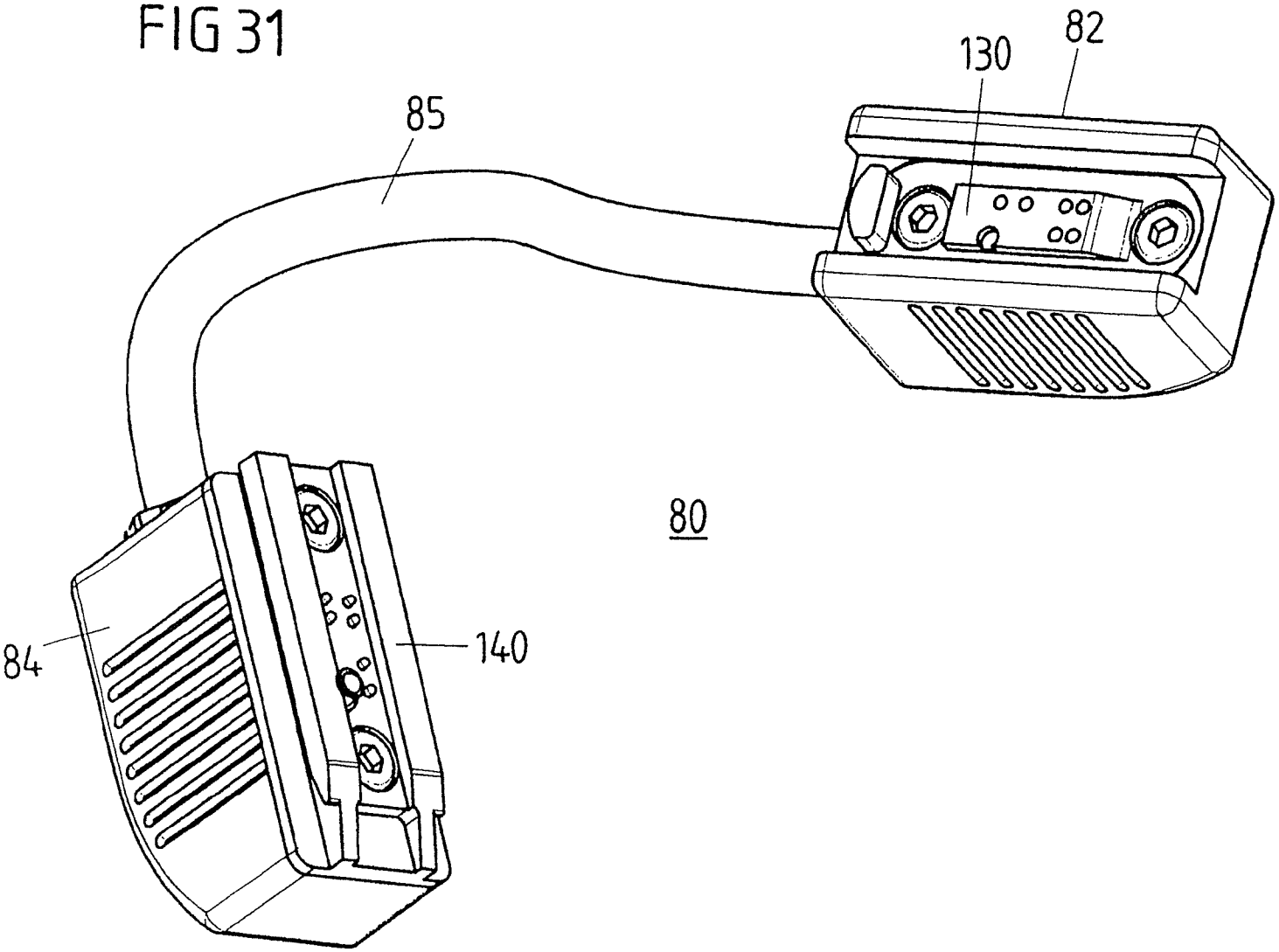
FIG. 31 shows a perspective representation of a connecting cable between two LED panels.

FIG. 31 shows a connecting cable 80 for electrically connecting two LED panels 1 with a cable 85 with plug connectors 82, 84 at its end, which as input and output plug connectors 130, 140 are equipped with spring contact pins or with flat contacts and a bore or a spherical latching bolt, respectively.

In this first embodiment of a modular lighting system schematically shown in FIG. 1, preferably all LED panels 1 or LED panel groups 1' are coupled to the power supply and docking station 5 in a star-shaped manner by means of power and data cables.

In an alternative embodiment of the modular lighting system as shown in FIG. 2, the power supply and docking station 5 is omitted and the control device 6 performs all control functions. In this embodiment, a data radio module 18 is plugged onto each LED panel 1 or each LED panel group 1', which directly communicates with the control device 6, wherein to the respective data radio module 18 or LED panel 1 or to each LED panel group 1' power is only supplied from a power supply unit or a battery and the data transmission is effected by radio.

Figure 32:
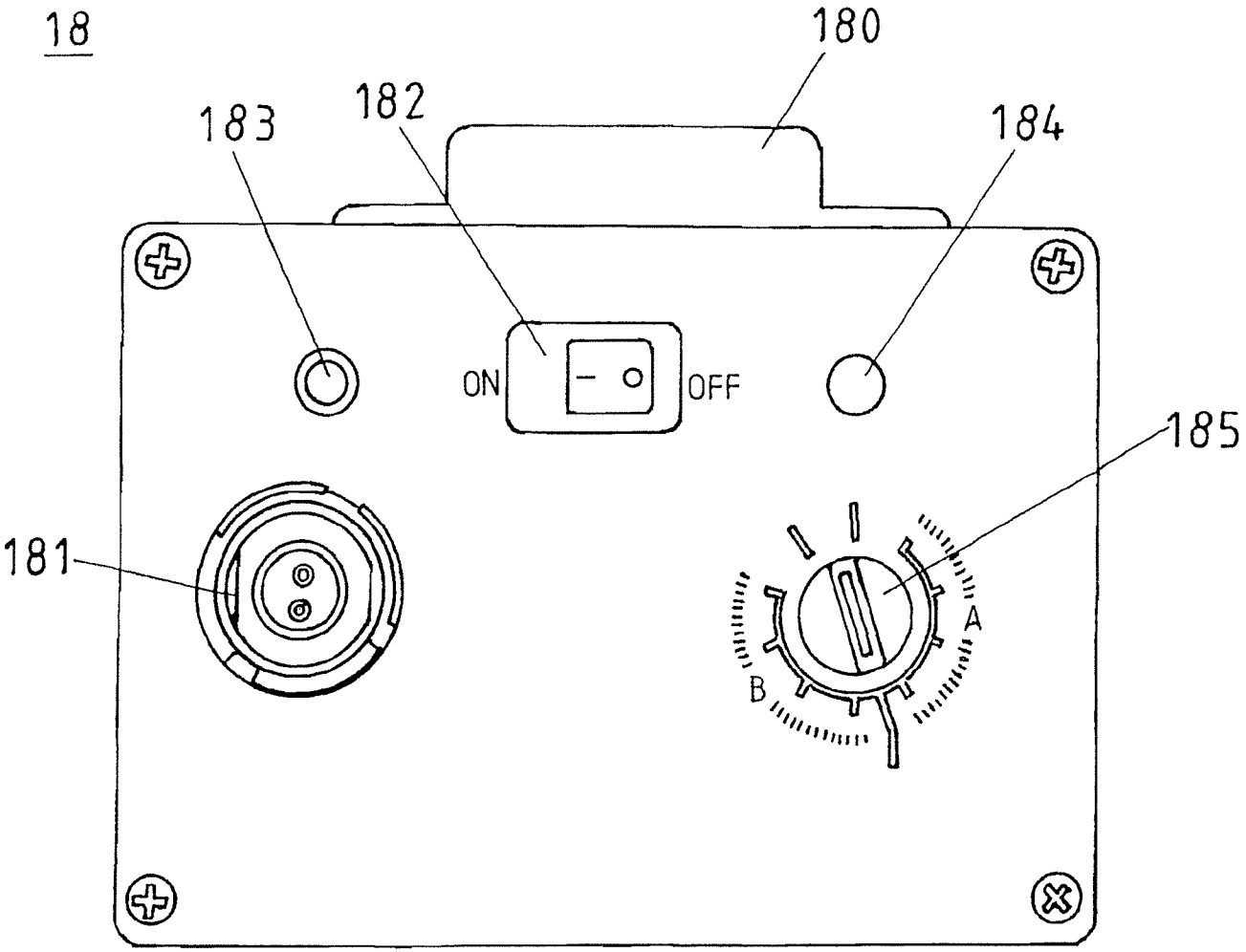
FIG. 32 shows a top view of a data radio module for docking to an LED panel.

FIG. 32 shows a top view of a data radio module 18 for docking to an LED panel 1 or an LED panel group 1', which communicates in a wireless manner with the control device 6 via a radio antenna covered by a plastic cover 180. On the non-illustrated rear side, the data radio module 18 contains a plug contact for docking to an LED panel 101 or an LED panel group 1', a power supply terminal 181, an on/off switch 182 as well as control lamps 183, 184 and a rotary switch 185 for setting the transmission channel and for entering an LED to be actuated of an LED panel.

Figure 33:
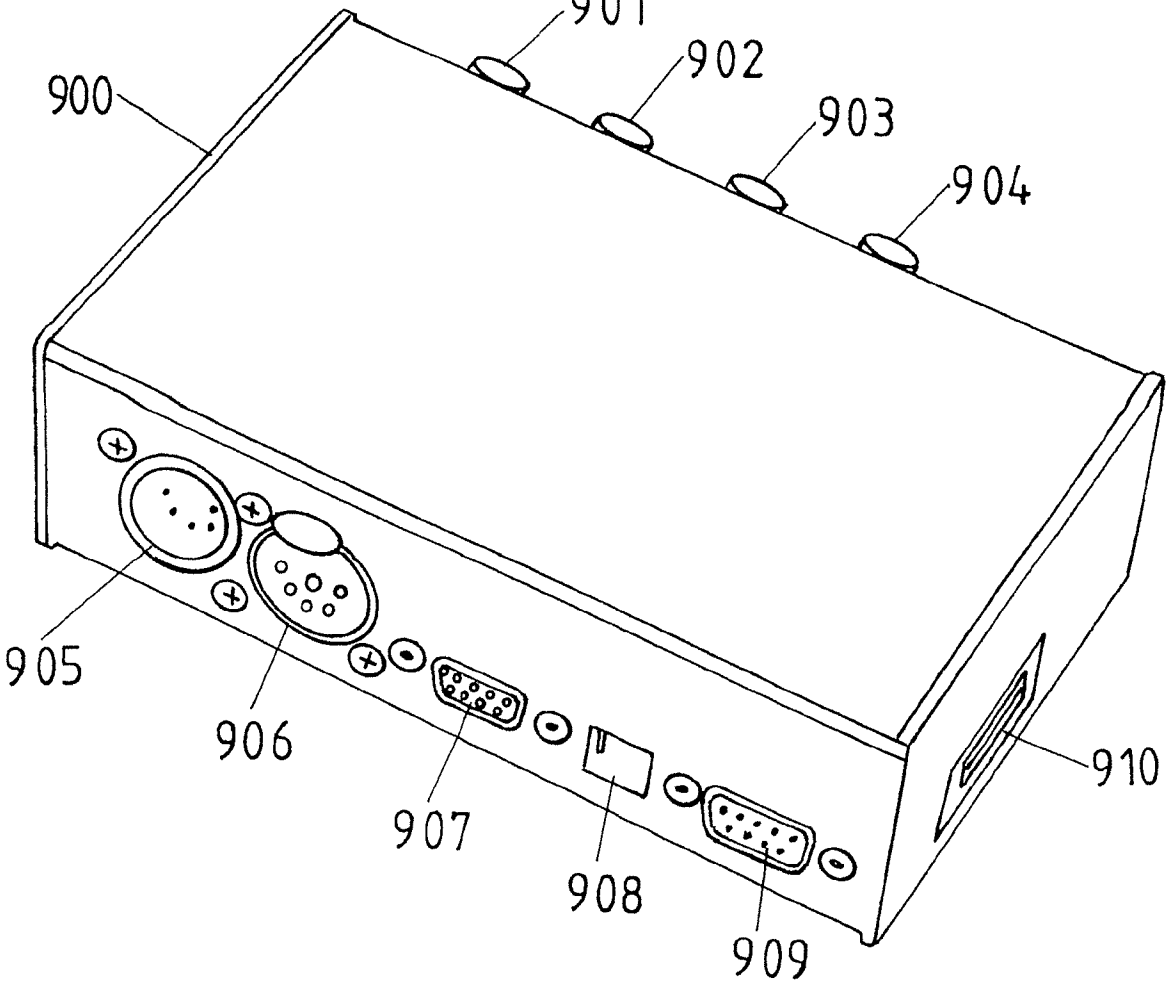
FIG. 33 shows a perspective view of a system distributor used in the embodiment of the modular lighting system as shown in FIG. 2.

FIG. 33 shows a system distributor 9 used in the embodiment of the modular lighting system of FIG. 2, which can be connected with the control device 6 via a contact strip 910. The system distributor 9 includes a power supply terminal 900, four line connections 901 to 904, a DMX input 905 and DMX output 906, PC and programming terminals 907,908 and a CAN terminal 909.

If the LED panel is intended to emit light only in a preprogrammed setting, a so-called "power adapter" can also be connected to the LED panel 1 or an LED-panel group 1' instead of a power supply and docking station 5 and a control device 6, which only includes a socket for the power supply to the LED panel or the LED-panel group 1'.

Figure 34:
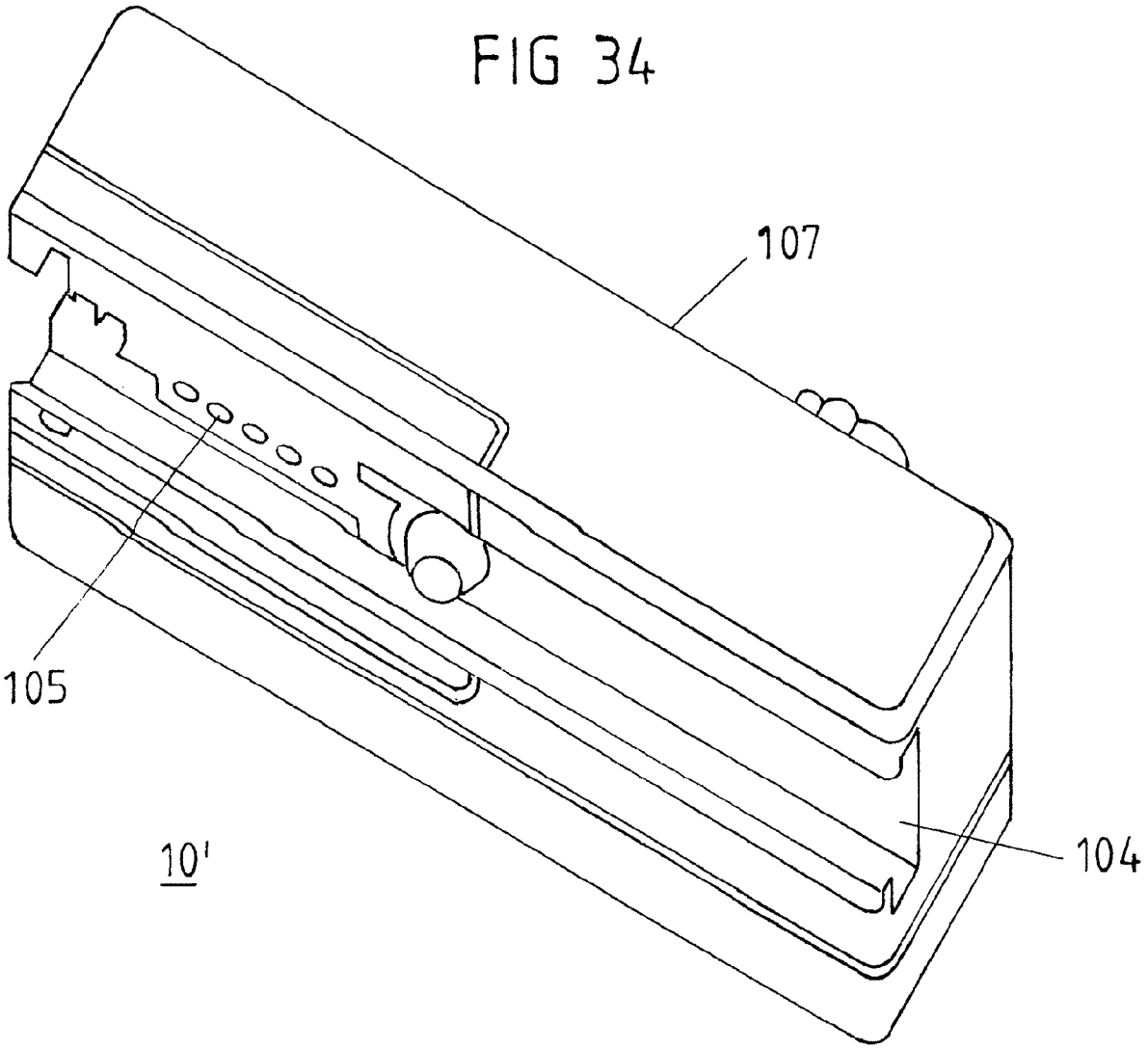
FIG. 34 shows a perspective representation of an accumulator to be docked to an LED panel, which is used as "power adapter" in the embodiment of the modular lighting system as shown in FIG. 2.

FIG. 34 shows such power adapter 10' used in the embodiment of the modular lighting system of FIG. 2, which via a docking connection 104 can be docked to an LED panel 1 or an LED panel group 1' and via spring contacts 105 can be contacted with corresponding counter-contacts of the LED panel 1 or the LED panel group 1'.

If an actuation via DMX 512, via a personal computer or via a serial interface is desired, the control device 6 still performs the communication, wherein a so-called system distributor 9 is connected to the control device 6, which contains the plug connectors and signal converters required for this purpose.

The radio modules can be adjusted to various (hardware) channels, i.e. to various frequencies and (software) addresses, so that either a plurality of LED panels 1 or LED panel groups 1' are simultaneously actuated on the same channel or each LED panel 1 or each LED panel group 1' is operated on a separate channel.

Figure 35:
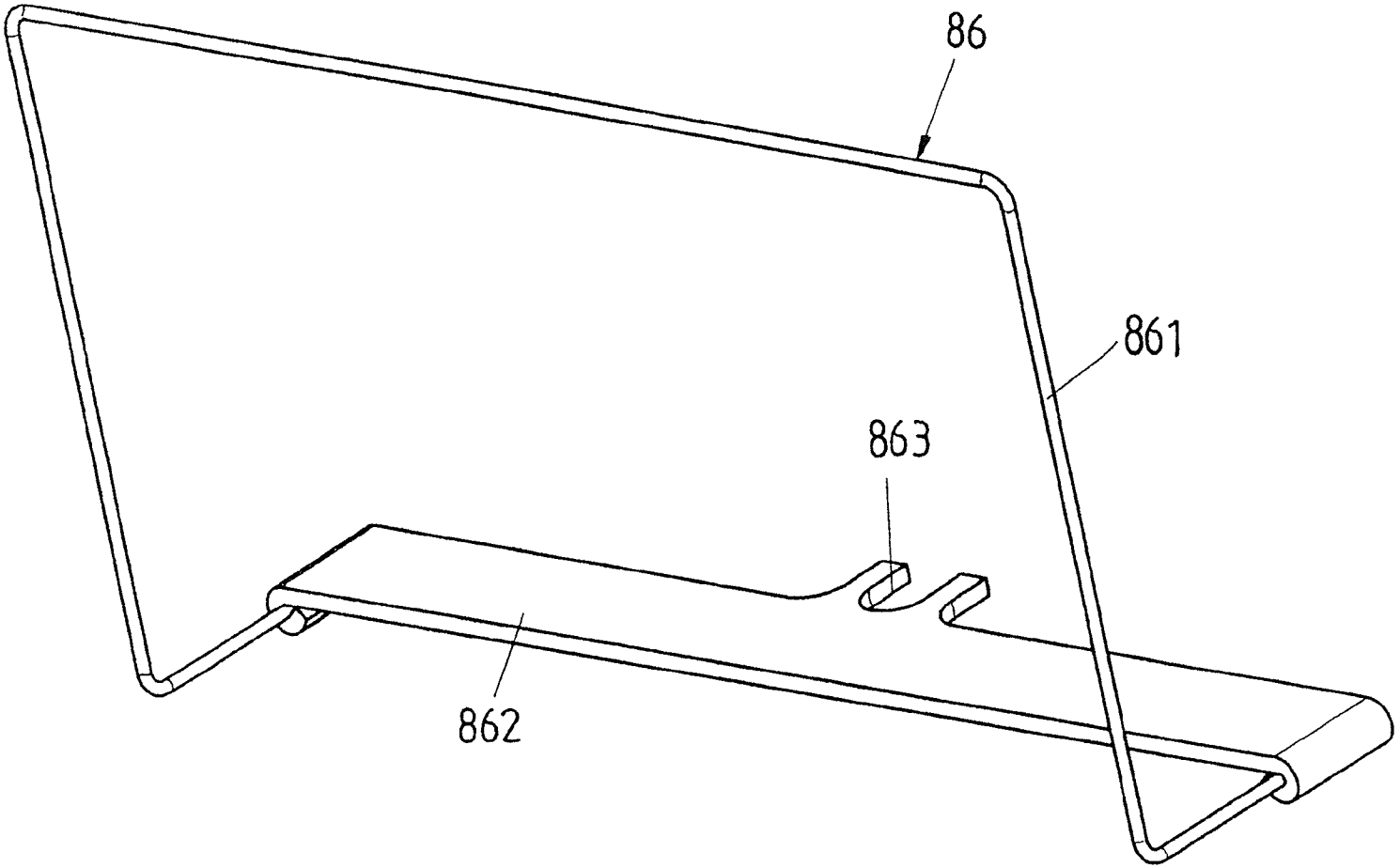
FIG. 35 shows an isometric view of a foil holder for mounting diffuser and effect foils in front of one or more LED panels.
Figure 36:
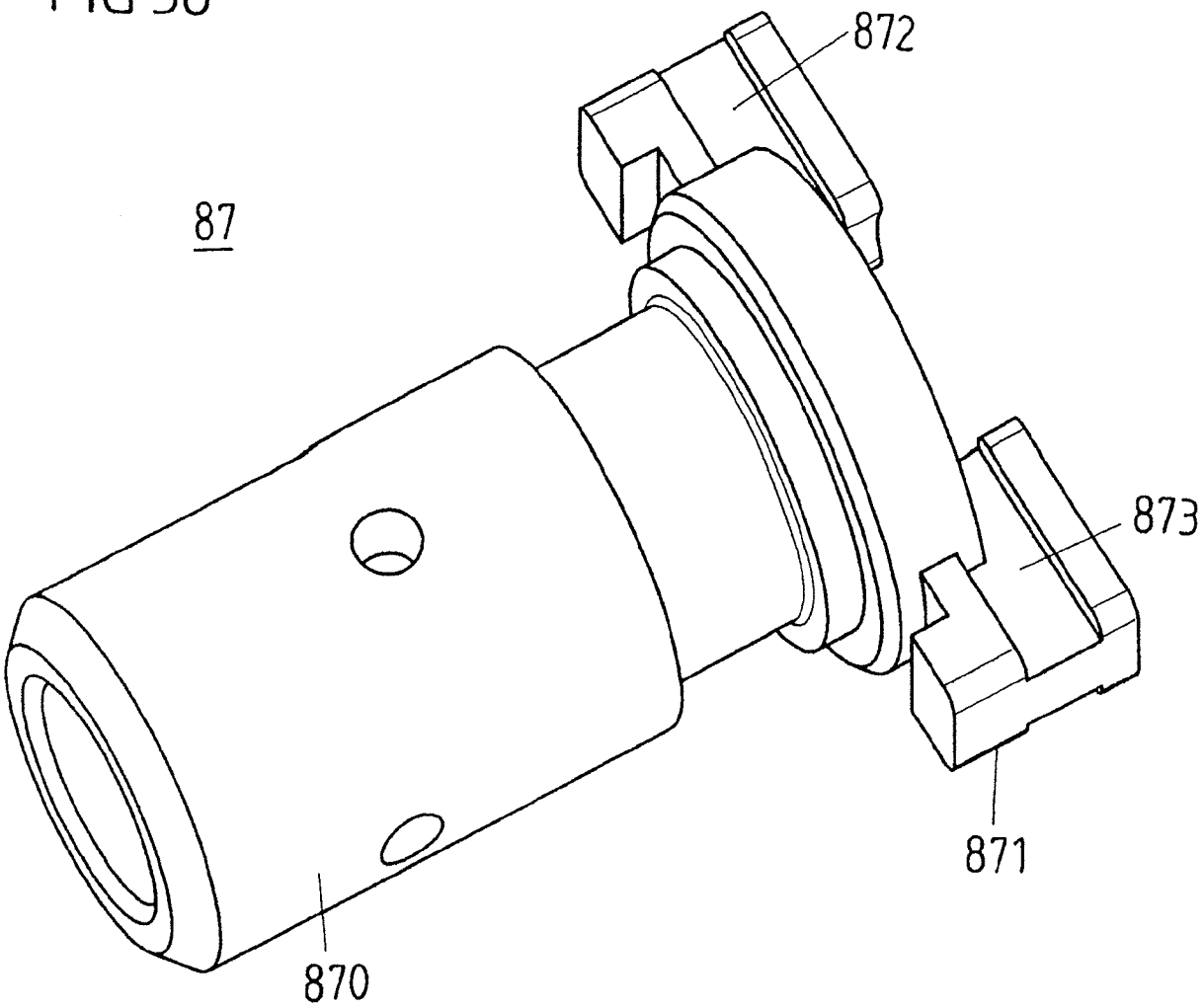
FIG. 36 shows an isometric view of a stand pin for attachment of LED panels to stands and fixtures.
Figure 37:
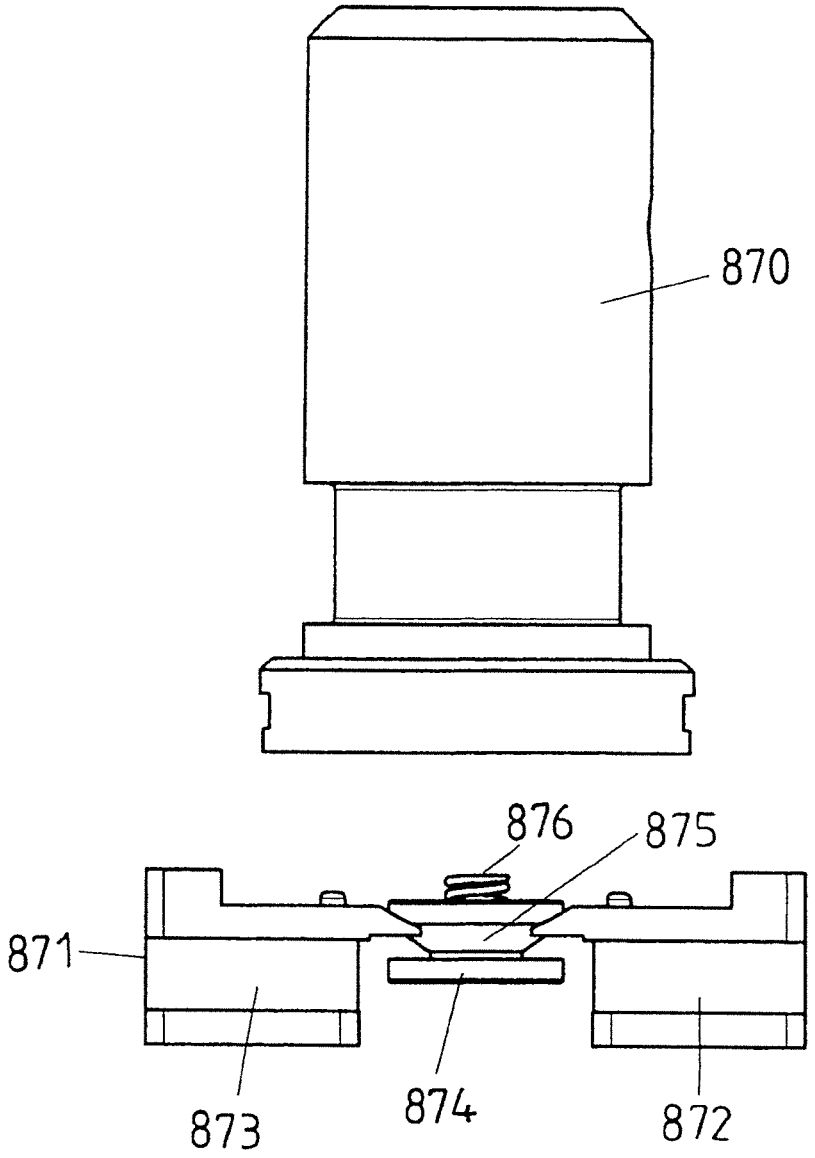
FIG. 37 shows a side view of the stand pin as shown in FIG. 30 with the stand pin put away.

FIGS. 35 to 37 show various accessory parts to the LED lighting system of the invention, which can be completed as required by further accessories for the functional extension of the LED lighting system.

FIG. 35 shows an isometric view of a foil holder 86 for mounting diffuser and effect foils in front of the LED panels 1, which by means of a knurled screw inserted through a claw 863 of a foil holder base 862 is attached to a thread of the LED panel 1, so that the foil holder 86 formed as wire strap 861 comes to lie in front of the soft or spot optic. The foils can then be clamped before the optical device by means of the wire strap 861.

A connecting pin 87 shown in FIGS. 36 and 37 for mounting one or more LED panels 1 to a stand, rig or other fixture is composed of a spigot 870, which is connectable with the pin or bolt of a stand, rig or other fixture by plugging onto the same, and of a T-shaped slide 871, 872 with a T-shaped cross-section 873 and a centrally biased locking disk 874. The T-shaped slide 871, 872, which can be inserted into the mounts 152, 153, 154 (FIG. 6), which are integrated in the heat sink surface 15 of the LED panels 1, centrally is biased laterally with respect to the spigot 870 by means of the locking disk 874 biased by means of a spring 876, so that in the output or rest position the lateral slides 871, 872 take the position shown in FIG. 36.

By compressing the lateral slides 871, 872 by means of thumb and index finger and by inserting the slide 871, 872 into the T-shaped grooves on the mounts 152, 153, 154 integrated in the heat sink surface 15 and by releasing the slide 871, 872, so that the connecting pin 87 is positively connected with the bottom surface of the LED panel 1, the connecting pin 87 can be shifted, until it audibly engages in one of the circular depressions 155, 156, 157 (FIG. 6) on the bottom surface of the LED panel 1.

In a side view with the spigot 870 put away, FIG. 37 shows the connecting pin 87 with the locking disk 874 arranged in the middle of the slide 871, which locking disk engages in the mounts of the heat sink surface on the bottom surface of the LED panel. By compressing the lateral slides 871, 872, the locking disk 874 is lifted due to the inclined surface 875 connected with the locking disk 874 and is pressed down by the spring 876 connected with the inclined surface 875. The connection between the connecting pin 87 and the LED panel 1 thus is accomplished in that the lateral slides 871, 872 are positively connected with the recess profile of the heat sink surface and due to the spring pressure the locking disk 874 engages in the depressions arranged in the heat sink surface on the bottom surface of the LED panel.

The invention claimed is:

1. A lighting system, comprising:

at least one light-emitting diode (LED) panel comprising:

a circuit board;

a housing frame surrounding the circuit board; and a plurality of similar lighting modules mounted on the circuit board and arranged in the housing frame, the housing frame comprising:

a first electromechanical plug connector coupled to a first sidewall of the housing frame, the first electromechanical plug connector comprising a plurality of spring contact pins arranged in a raster;

wherein the first electromechanical plug connector is configured to electrically and mechanically connect the LED panel to at least one component selected from the group of components consisting of a similar LED panel, an accumulator, a decentralized control element, a control device, a power supply, a docking station, and a cross connector;

wherein each of the plurality of spring pins is configured to move in a direction between a depressed position and an extended position; and wherein a direction for mechanically connecting the first electromechanical plug connector to the component is generally perpendicular to the direction in which the plurality of spring pins move between the depressed and extended positions.

2. The lighting system of claim 1, further comprising a second electromechanical plug connector coupled to a second sidewall of the housing frame, the second electromechanical plug connector comprising a plurality of flats arranged in a raster corresponding to the raster of the spring contact pins.

3. The lighting system of claim 2, wherein the second electromechanical plug connector further comprises a ramp and wherein the plurality of flats are on the ramp.

4. The lighting system of claim 1, wherein the first electromechanical plug connector further comprises a pair of rails and wherein the plurality of spring contact pins are between the pair of rails.

5. The lighting system of claim 4, wherein the first electromechanical plug connector further comprises a lead-in bevel on one end of the pair of rails.

6. The lighting system of claim 3, wherein the second electromechanical plug connector further comprises:

an end stop; and a segmental bore configured to receive a ball of latching bolt.

7. The lighting system of claim 1, wherein the at least one LED panel comprises a plurality of connected LED panels arranged in a matrix-like configuration.

8. The lighting system of claim 1, further comprising a control element connected to the first electromechanical plug connector for controlling individual lighting parameters of the LED panel.

9. The lighting system of claim 1, further comprising a central power control unit connected to the first electromechanical plug connector.

10. The lighting system of claim 9, wherein the central power control unit comprises:

a docking station comprising a data transmission line and at least one terminal for receiving power from a power supply; and a control device connected to the docking station with a wireless and/or wire-bound connection.

11. The lighting system of claim 1, further comprising:

a data radio module wirelessly connected to the at least one LED panel; and a control device configured to perform all control functions and transmit data and control signals to the data radio module.

12. The lighting system of claim 1, wherein the housing frame further comprises:

a bottom heat sink surface having a plurality of cooling fins; and at least one mount configured to receive a connecting element.

13. The lighting system of claim 1, wherein the circuit board further comprises:

a plurality of openings for receiving the lighting modules;

a plurality of fastening devices for the lighting modules;

a power supply;

interface electronics for the lighting modules;

a microprocessor for colorimetric calculations and convection temperature compensation; and wherein the first electromechanical plug connector is located along a lateral edge of the circuit board.

14. The lighting system of claim 1, wherein an upper surface of the housing frame further comprises a receiving device for receiving an optical device including either optics associated with a particular one of the lighting modules or an optical common to all of the lighting modules.

15. The lighting system of claim 14, wherein the receiving device comprises a plug connection or a tongue-and-groove connection arranged at an upper edge of the housing frame.

16. The lighting system of claim 1, further comprising at least one non-reflective glass pane covering a light-emitting side of the at least one LED panel.

17. The lighting system of claim 14, wherein the optical device comprises a soft optic with a beam-expanding device and a plate diffusely reflecting light.

18. The lighting system of claim 17, wherein the soft optic comprises:

a highly mirrored plastic or sheet metal housing; and a diffuse reflecting plate coupled to the at least one LED panel by a plurality of magnets.

19. The lighting system of claim 14, wherein the optical device comprises a spot optic comprising:

a frame coupled to the housing frame; and a plurality of condenser plates arranged on an upper surface of the frame for light mixing.

20. The lighting system of claim 19, wherein the spot optic further comprises a plurality of TIR lenses arranged below the condenser plates and wherein each one of the TIR lenses is individually associated with one of the lighting modules.

21. The lighting system of claim 19, wherein the spot optic is coupled to the LED panel by a plurality of magnets and the spot optic further includes a plurality of magnets on a light-emitting side of the spot optic for accommodating optical accessories.

22. A lighting system, comprising:

at least one light-emitting diode (LED) panel comprising:

a circuit board;

a housing frame surrounding the circuit board; and a plurality of similar lighting modules mounted on the circuit board and arranged in the housing frame, the housing frame comprising:

a first electromechanical plug connector coupled to a first sidewall of the housing frame, the first electromechanical plug connector comprising a plurality of flat contacts arranged in a raster;

wherein the first electromechanical plug connector is configured to electrically and mechanically connect the LED panel to at least one component selected from the group of components consisting of a similar LED panel, an accumulator, a decentralized control element, a control device, a power supply, a docking station, and a cross connector each having a pair of rails and a plurality of spring contact pins arranged in a raster between the pair of rails;

wherein the first electromechanical plug connector includes first and second regions for receiving the pair of rails on the component; and wherein the plurality of flat contacts on the first electromechanical plug connector are between the first and second regions for receiving the pair of rails.

23. The lighting system of claim 22, further comprising a second electromechanical plug connector coupled to a second sidewall of the housing frame, the second electromechanical plug connector comprising a plurality of spring contact pins arranged in a raster corresponding to the raster of the flat contacts.

24. The lighting system of claim 23, wherein the second electromechanical plug connector further comprises a pair of rails and wherein the plurality of spring contact pins are between the pair of rails.

25. The lighting system of claim 22, wherein the first electromechanical plug connector further comprises a ramp and wherein the flat contacts are located on the ramp.

26. The lighting system of claim 24, wherein the second electromechanical plug connector further comprises a lead-in bevel on one end of the pair of rails.

27. The lighting system of claim 25, wherein the first electromechanical plug connector further comprises:

an end stop; and a segmental bore configured to receive a ball of latching bolt.

28. The lighting system of claim 22, wherein the at least one LED panel comprises a plurality of connected LED panels arranged in a matrix-like configuration.

29. The lighting system of claim 22, further comprising a control element connected to the first electromechanical plug connector for controlling individual lighting parameters of the LED panel.

30. The lighting system of claim 22, further comprising a central power control unit connected to the first electromechanical plug connector.

31. The lighting system of claim 30, wherein the central power control unit comprises:

a docking station comprising a data transmission line and at least one terminal for receiving power from a power supply; and a control device connected to the docking station with a wireless and/or wire-bound connection.

32. The lighting system of claim 22, further comprising:

a data radio module wirelessly connected to the at least one LED panel; and a control device configured to perform all control functions and transmit data and control signals to the data radio module.

33. The lighting system of claim 22, wherein the housing frame further comprises:

a bottom heat sink surface having a plurality of cooling fins; and at least one mount configured to receive a connecting element.

34. The lighting system of claim 22, wherein the circuit board further comprises:

a plurality of openings for receiving the lighting modules;

a plurality of fastening devices for the lighting modules;

a power supply;

interface electronics for the lighting modules;

a microprocessor for colorimetric calculations and convection temperature compensation; and wherein the first electromechanical plug connector is located along a lateral edge of the circuit board.

35. The lighting system of claim 22, wherein an upper surface of the housing frame further comprises a receiving device for receiving an optical device including either optics associated with a particular one of the lighting modules or an optical common to all of the lighting modules.

36. The lighting system of claim 35, wherein the receiving device comprises a plug connection or a tongue-and-groove connection arranged at an upper edge of the housing frame.

37. The lighting system of claim 22, further comprising at least one non-reflective glass pane covering a light-emitting side of the at least one LED panel.

38. The lighting system of claim 35, wherein the optical device comprises a soft optic with a beam-expanding device and a plate diffusely reflecting light.

39. The lighting system of claim 38, wherein the soft optic comprises:

a highly mirrored plastic or sheet metal housing; and a diffuse reflecting plate coupled to the at least one LED panel by a plurality of magnets.

40. The lighting system of claim 35, wherein the optical device comprises a spot optic comprising:

a frame coupled to the housing frame; and a plurality of condenser plates arranged on an upper surface of the frame for light mixing.

41. The lighting system of claim 40, wherein the spot optic further comprises a plurality of TIR lenses arranged below the condenser plates and wherein each one of the TIR lenses is individually associated with one of the lighting modules.

42. The lighting system of claim 40, wherein the spot optic is coupled to the LED panel by a plurality of magnets and the spot optic further includes a plurality of magnets on a light-emitting side of the spot optic for accommodating optical accessories.

43. A lighting system, comprising:

at least one light-emitting diode (LED) panel comprising:

a circuit board;

a housing frame surrounding the circuit board; and a plurality of similar lighting modules mounted on the circuit board and arranged in the housing frame, the housing frame comprising:

a first electromechanical plug connector coupled to a first sidewall of the housing frame, the first electromechanical plug connector comprising a ramp and a plurality of flat contacts arranged in a raster on the ramp;

a second electromechanical plug connector coupled to a second sidewall of the housing frame, the second electromechanical plug connector comprising a pair of rails and a plurality of spring contact pins arranged in a raster between the pair of rails;

wherein each of the first and second electromechanical plug connectors is configured to electrically and mechanically connect the LED panel to at least one component selected from the group of components consisting of a similar LED panel, an accumulator, a decentralized control element, a control device, a power supply, a docking station, and a cross connector;

wherein each of the plurality of spring pins is configured to move in a direction between a depressed position and an extended position; and wherein a direction for mechanically connecting each of the first and second electromechanical plug connectors to the component is generally perpendicular to the direction in which the plurality of spring pins move between the depressed and extended positions.

* * * * *